US007802495B2

(12) United States Patent
Oxford et al.

(10) Patent No.: US 7,802,495 B2
(45) **Date of Patent: *Sep. 28, 2010**

(54) METHODS OF FORMING EARTH-BORING ROTARY DRILL BITS

(75) Inventors: James A. Oxford, Magnolia, TX (US); Jimmy W. Eason, The Woodlands, TX (US); Redd H. Smith, The Woodlands, TX (US); John H. Stevens, Spring, TX (US); Nicholas J. Lyons, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 440 days.

This patent is subject to a terminal disclaimer.

(21) Appl. No.: 11/271,153

(22) Filed: Nov. 10, 2005

(65) Prior Publication Data

US 2007/0102198 A1 May 10, 2007

(51) Int. Cl.
*B21K 5/04* (2006.01)
*E21B 10/54* (2006.01)

(52) U.S. Cl. ..... 76/108.2; 175/425

(58) Field of Classification Search ..... 76/108.1, 76/108.2, 108.4; 419/5–8, 12–14, 18; 175/374, 175/425

See application file for complete search history.

(56) References Cited

U.S. PATENT DOCUMENTS 1,954,166 A 4/1934 Campbell
2,299,207 A 10/1942 Bevillard
2,507,439 A 5/1950 Goolsbee
2,819,958 A 1/1958 Abkowitz et al.

(Continued)

FOREIGN PATENT DOCUMENTS

AU 695583 2/1998

(Continued)

OTHER PUBLICATIONS

U.S. Appl. No. 11/272,439, filed Nov. 10, 2005, entitled "Earth-Boring Rotary Drill Bits and Methods of Manufacturing Earth-Boring Rotary Drill Bits Having Particle-Matrix Composite Bit Bodies."

(Continued)

*Primary Examiner*—Hwei-Siu C Payer
(74) *Attorney, Agent, or Firm*—TraskBritt

(57) ABSTRACT

Methods of forming earth-boring rotary drill bits include providing a bit body, providing a shank that is configured for attachment to a drill string, and attaching the shank to the bit body. Providing a bit body includes providing a green powder component having a first region having a first composition and a second region having a second, different composition, and at least partially sintering the green powder component. Other methods include providing a powder mixture, pressing the powder mixture to form a green component, and sintering the green component to a final density. A shank is provided that includes an aperture, and a feature is machined in a surface of the bit body. The aperture is aligned with the feature, and a retaining member is inserted through the aperture. An earth-boring bit includes a bit body comprising a particle-matrix composite material including a plurality of hard particles dispersed throughout a matrix material. A shank is attached to the bit body using a retaining member.

17 Claims, 11 Drawing Sheets

U.S. PATENT DOCUMENTS

| | | | | |
|---|---|---|---|---|
| 2,819,959 | A | | 1/1958 | Abkowitz et al. |
| 2,906,654 | A | | 9/1959 | Abkowitz |
| 3,368,881 | A | | 2/1968 | Abkowitz et al. |
| 3,471,921 | A | | 10/1969 | Feenstra |
| 3,660,050 | A | | 5/1972 | Iler et al. |
| 3,757,879 | A | | 9/1973 | Wilder et al. |
| 3,987,859 | A | | 10/1976 | Lichte |
| 4,017,480 | A | | 4/1977 | Baum |
| 4,047,828 | A | | 9/1977 | Makely |
| 4,094,709 | A | | 6/1978 | Rozmus |
| 4,128,136 | A | | 12/1978 | Generoux |
| 4,134,759 | A | | 1/1979 | Yajima et al. |
| 4,198,233 | A | | 4/1980 | Frehn |
| 4,221,270 | A | | 9/1980 | Vezirian |
| 4,229,638 | A | | 10/1980 | Lichte |
| 4,233,720 | A | | 11/1980 | Rozmus |
| 4,252,202 | A | | 2/1981 | Purser, Sr. |
| 4,255,165 | A | | 3/1981 | Dennis et al. |
| 4,306,139 | A | | 12/1981 | Shinozaki et al. |
| 4,341,557 | A | | 7/1982 | Lizenby |
| 4,389,952 | A | | 6/1983 | Dreier et al. |
| 4,398,952 | A | | 8/1983 | Drake |
| 4,499,048 | A | | 2/1985 | Hanejko |
| 4,499,795 | A | | 2/1985 | Radtke |
| 4,499,958 | A | | 2/1985 | Radtke et al. |
| 4,526,748 | A | | 7/1985 | Rozmus |
| 4,547,337 | A | | 10/1985 | Rozmus |
| 4,552,232 | A | | 11/1985 | Frear |
| 4,554,130 | A | | 11/1985 | Ecer |
| 4,562,990 | A | | 1/1986 | Rose |
| 4,596,694 | A | | 6/1986 | Rozmus |
| 4,597,730 | A | | 7/1986 | Rozmus |
| 4,620,600 | A | | 11/1986 | Persson |
| 4,630,693 | A | | 12/1986 | Goodfellow |
| 4,656,002 | A | | 4/1987 | Lizenby et al. |
| 4,667,756 | A | | 5/1987 | King et al. |
| 4,686,080 | A | | 8/1987 | Hara et al. |
| 4,694,919 | A | | 9/1987 | Barr |
| 4,738,322 | A | * | 4/1988 | Hall et al. ..... 175/371 |
| 4,743,515 | A | | 5/1988 | Fischer et al. |
| 4,744,943 | A | | 5/1988 | Timm |
| 4,809,903 | A | | 3/1989 | Eylon et al. |
| 4,838,366 | A | | 6/1989 | Jones |
| 4,871,377 | A | | 10/1989 | Frushour |
| 4,884,477 | A | | 12/1989 | Smith et al. |
| 4,889,017 | A | | 12/1989 | Fuller et al. |
| 4,919,013 | A | | 4/1990 | Smith et al. |
| 4,923,512 | A | | 5/1990 | Timm et al. |
| 4,956,012 | A | | 9/1990 | Jacobs et al. |
| 4,968,348 | A | | 11/1990 | Abkowitz et al. |
| 4,981,665 | A | | 1/1991 | Boecker et al. |
| 5,000,273 | A | | 3/1991 | Horton et al. |
| 5,030,598 | A | | 7/1991 | Hsieh |
| 5,032,352 | A | | 7/1991 | Meeks et al. |
| 5,049,450 | A | | 9/1991 | Dorfman et al. |
| 5,090,491 | A | | 2/1992 | Tibbitts et al. |
| 5,101,692 | A | | 4/1992 | Simpson |
| 5,150,636 | A | | 9/1992 | Hill |
| 5,161,898 | A | | 11/1992 | Drake |
| 5,232,522 | A | | 8/1993 | Doktycz et al. |
| 5,281,260 | A | | 1/1994 | Kumar et al. |
| 5,286,685 | A | | 2/1994 | Schoennahl et al. |
| 5,311,958 | A | | 5/1994 | Isbell et al. |
| 5,348,806 | A | | 9/1994 | Kojo et al. |
| 5,373,907 | A | | 12/1994 | Weaver |
| 5,433,280 | A | | 7/1995 | Smith |
| 5,439,068 | A | | 8/1995 | Huffstutler et al. |
| 5,443,337 | A | | 8/1995 | Katayama |
| 5,479,997 | A | | 1/1996 | Scott et al. |
| 5,482,670 | A | | 1/1996 | Hong |
| 5,484,468 | A | | 1/1996 | Ostlund et al. |
| 5,506,055 | A | | 4/1996 | Dorfman et al. |
| 5,543,235 | A | | 8/1996 | Mirchandani et al. |
| 5,544,550 | A | | 8/1996 | Smith |
| 5,560,440 | A | | 10/1996 | Tibbitts |
| 5,586,612 | A | | 12/1996 | Isbell et al. |
| 5,593,474 | A | | 1/1997 | Keshavan et al. |
| 5,611,251 | A | | 3/1997 | Katayama |
| 5,612,264 | A | | 3/1997 | Nilsson et al. |
| 5,624,002 | A | * | 4/1997 | Huffstutler ..... 175/356 |
| 5,641,251 | A | | 6/1997 | Leins et al. |
| 5,641,921 | A | | 6/1997 | Dennis et al. |
| 5,662,183 | A | | 9/1997 | Fang |
| 5,666,864 | A | | 9/1997 | Tibbitts |
| 5,677,042 | A | | 10/1997 | Massa et al. |
| 5,679,445 | A | | 10/1997 | Massa et al. |
| 5,697,046 | A | | 12/1997 | Conley |
| 5,697,462 | A | | 12/1997 | Grimes et al. |
| 5,732,783 | A | | 3/1998 | Truax et al. |
| 5,733,649 | A | | 3/1998 | Kelley et al. |
| 5,733,664 | A | | 3/1998 | Kelley et al. |
| 5,753,160 | A | | 5/1998 | Takeuchi et al. |
| 5,765,095 | A | | 6/1998 | Flak et al. |
| 5,776,593 | A | | 7/1998 | Massa et al. |
| 5,778,301 | A | | 7/1998 | Hong |
| 5,789,686 | A | | 8/1998 | Massa et al. |
| 5,792,403 | A | | 8/1998 | Massa et al. |
| 5,806,934 | A | | 9/1998 | Massa et al. |
| 5,829,539 | A | | 11/1998 | Newton et al. |
| 5,830,256 | A | | 11/1998 | Northrop et al. |
| 5,856,626 | A | | 1/1999 | Fischer et al. |
| 5,865,571 | A | | 2/1999 | Tankala et al. |
| 5,880,382 | A | | 3/1999 | Fang et al. |
| 5,897,830 | A | | 4/1999 | Abkowitz et al. |
| 5,904,212 | A | | 5/1999 | Arfele |
| 5,947,214 | A | | 9/1999 | Tibbitts |
| 5,957,006 | A | | 9/1999 | Smith |
| 5,963,775 | A | | 10/1999 | Fang |
| 5,967,248 | A | | 10/1999 | Drake et al. |
| 5,980,602 | A | | 11/1999 | Carden |
| 6,029,544 | A | | 2/2000 | Katayama |
| 6,045,750 | A | | 4/2000 | Drake et al. |
| 6,051,171 | A | | 4/2000 | Takeuchi et al. |
| 6,063,333 | A | | 5/2000 | Dennis |
| 6,068,070 | A | | 5/2000 | Scott |
| 6,073,518 | A | | 6/2000 | Chow et al. |
| 6,086,980 | A | | 7/2000 | Foster et al. |
| 6,089,123 | A | | 7/2000 | Chow et al. |
| 6,099,664 | A | | 8/2000 | Davies et al. |
| 6,148,936 | A | | 11/2000 | Evans et al. |
| 6,200,514 | B1 | | 3/2001 | Meister |
| 6,209,420 | B1 | | 4/2001 | Butcher et al. |
| 6,214,134 | B1 | | 4/2001 | Eylon et al. |
| 6,214,287 | B1 | | 4/2001 | Waldenstrom |
| 6,220,117 | B1 | | 4/2001 | Butcher |
| 6,227,188 | B1 | | 5/2001 | Tankala et al. |
| 6,228,139 | B1 | | 5/2001 | Oskarsson |
| 6,241,036 | B1 | | 6/2001 | Lovato et al. |
| 6,254,658 | B1 | | 7/2001 | Taniuchi et al. |
| 6,284,014 | B1 | | 9/2001 | Carden |
| 6,287,360 | B1 | | 9/2001 | Kembaiyan et al. |
| 6,290,438 | B1 | | 9/2001 | Papajewski |
| 6,293,986 | B1 | | 9/2001 | Rodiger et al. |
| 6,348,110 | B1 | | 2/2002 | Evans |
| 6,375,706 | B2 | | 4/2002 | Kembaiyan et al. |
| 6,453,899 | B1 | | 9/2002 | Tselesin |
| 6,454,025 | B1 | | 9/2002 | Runquist et al. |
| 6,454,028 | B1 | | 9/2002 | Evans |
| 6,454,030 | B1 | | 9/2002 | Findley et al. |
| 6,458,471 | B2 | | 10/2002 | Lovato et al. |
| 6,474,425 | B1 | | 11/2002 | Truax et al. |
| 6,500,226 | B1 | | 12/2002 | Dennis |
| 6,511,265 | B1 | | 1/2003 | Mirchandani et al. |
| 6,576,182 | B1 | | 6/2003 | Ravagni et al. |

| | | | | |
|---|---|---|---|---|
| 6,589,640 | B2 | 7/2003 | Griffin et al. | |
| 6,599,467 | B1 | 7/2003 | Yamaguchi et al. | |
| 6,607,693 | B1 | 8/2003 | Saito et al. | |
| 6,655,481 | B2 | 12/2003 | Findley et al. | |
| 6,685,880 | B2 | 2/2004 | Engstrom et al. | |
| 6,742,608 | B2 | 6/2004 | Murdoch | |
| 6,742,611 | B1 | 6/2004 | Illerhaus et al. | |
| 6,756,009 | B2 | 6/2004 | Sim et al. | |
| 6,766,870 | B2 | 7/2004 | Overstreet | |
| 6,849,231 | B2 | 2/2005 | Kojima et al. | |
| 6,918,942 | B2 | 7/2005 | Hatta et al. | |
| 7,044,243 | B2 | 5/2006 | Kembaiyan et al. | |
| 7,048,081 | B2 | 5/2006 | Smith et al. | |
| 7,513,320 | B2 * | 4/2009 | Mirchandani et al. | 175/426 |
| 2002/0004105 | A1 | 1/2002 | Kunze et al. | |
| 2003/0010409 | A1 | 1/2003 | Kunze et al. | |
| 2004/0007393 | A1 * | 1/2004 | Griffin | 175/434 |
| 2004/0013558 | A1 | 1/2004 | Kondoh et al. | |
| 2004/0060742 | A1 | 4/2004 | Kembaiyan et al. | |
| 2004/0196638 | A1 | 10/2004 | Lee et al. | |
| 2004/0243241 | A1 | 12/2004 | Istephanous et al. | |
| 2004/0245022 | A1 | 12/2004 | Izaguirre et al. | |
| 2004/0245024 | A1 | 12/2004 | Kembaiyan | |
| 2005/0008524 | A1 | 1/2005 | Testani | |
| 2005/0072496 | A1 | 4/2005 | Hwang et al. | |
| 2005/0084407 | A1 | 4/2005 | Myrick | |
| 2005/0117984 | A1 | 6/2005 | Eason et al. | |
| 2005/0126334 | A1 | 6/2005 | Mirchandani | |
| 2005/0211474 | A1 | 9/2005 | Nguyen et al. | |
| 2005/0211475 | A1 | 9/2005 | Mirchandani et al. | |
| 2005/0247491 | A1 | 11/2005 | Mirchandani et al. | |
| 2005/0268746 | A1 | 12/2005 | Abkowitz et al. | |
| 2006/0016521 | A1 | 1/2006 | Hanusiak et al. | |
| 2006/0032677 | A1 | 2/2006 | Azar et al. | |
| 2006/0043648 | A1 | 3/2006 | Takeuchi et al. | |
| 2006/0057017 | A1 | 3/2006 | Woodfield et al. | |
| 2006/0131081 | A1 | 6/2006 | Mirchandani et al. | |
| 2007/0042217 | A1 | 2/2007 | Fang et al. | |

FOREIGN PATENT DOCUMENTS

| | | | |
|---|---|---|---|
| CA | 2212197 | | 10/2000 |
| EP | 0 264 674 | A2 | 4/1988 |
| EP | 0 453 428 | A1 | 10/1991 |
| EP | 0 995 876 | A2 | 4/2000 |
| EP | 1 244 531 | B1 | 10/2002 |
| GB | 945227 | | 12/1963 |
| GB | 2203774 | A | 10/1988 |
| GB | 2 385 350 | A | 8/2003 |
| GB | 2 393 449 | A | 3/2004 |
| JP | 10 219385 | A | 8/1998 |
| WO | WO 03/049889 | A2 | 6/2003 |
| WO | WO 2004/053197 | A2 | 6/2004 |

OTHER PUBLICATIONS

PCT International Search Report for counterpart PCT International Application No. PCT/US2007/023275, mailed Apr. 11, 2008.

PCT International Search Report and Written Opinion of the International Search Authority for PCT Counterpart Application No. PCT/US2006/043670, mailed Apr. 2, 2007.

U.S. Appl. No. 60/566,063, filed Apr. 28, 2004, entitled "Body Materials for Earth Boring Bits" to Mirchandani et al.

PCT International Search Report and Written Opinion of the International Search Authority for PCT Application No. PCT/US2006/043669, mailed Apr. 13, 2007.

Alman, D.E., et al., "The Abrasive Wear of Sintered Titanium Matrix-Ceramic Particle Reinforced Composites," Wear, 225-229 (1999), pp. 629-639.

"Boron Carbide Nozzles and Inserts," Seven Stars International webpage http://www.concentric.net/~ctkang/nozzle.shtml, printed Sep. 7, 2006.

Choe, Heeman, et al., "Effect of Tungsten Additions on the Mechanical Properties of Ti-6A1-4V," Material Science and Engineering, A 396 (2005), pp. 99-106, Elsevier.

Diamond Innovations, "Composite Diamond Coatings, Superhard Protection of Wear Parts New Coating and Service Parts from Diamond Innovations" brochure, 2004.

Gale, W.F., et al., Smithells Metals Reference Book, Eighth Edition, 2003, p. 2117, Elsevier Butterworth Heinemann.

"Heat Treating of Titanium and Titanium Alloys," Key to Metals website article, www.key-to-metals.com, printed Sep. 21, 2006.

Miserez, A., et al. "Particle Reinforced Metals of High Ceramic Content," Material Science and Engineering A 387-389 (2004), pp. 822-831, Elsevier.

Warrier, S.G., et al., "Infiltration of Titanium Alloy-Matrix Composites," Journal of Materials Science Letters, 12 (1993), pp. 865-868, Chapman & Hall.

U.S. Appl. No. 11/540,912, filed Sep. 29, 2006, entitled "Earth-Boring Rotary Drill Bits Including Bit Bodies Having Boron Carbide Particles in Aluminum or Aluminum-Based Alloy Matrix Materials, and Methods for Forming Such Bits" to Choe et al.

Reed, James S., Principles of Ceramics Processing, Second Edition, 1995, pp. 215-227, John Wiley & Sons, Inc.

* cited by examiner

METHODS OF FORMING EARTH-BORING ROTARY DRILL BITS

CROSS-REFERENCE TO RELATED APPLICATION

U.S. patent application Ser. No. 11/272,439, filed on Nov. 10, 2005, in the name of Redd H. Smith, John H. Stevens, Jim Duggan, Nicholas J. Lyons, Jimmy W. Eason, Jared D. Gladney, James A. Oxford, and Benjamin J. Chrest, and entitled "Earth-Boring Rotary Drill Bits And Methods Of Manufacturing Earth-Boring Rotary Drill Bits Having Particle-Matrix Composite Bit Bodies," assigned to the assignee of the present application, is hereby incorporated by reference.

BACKGROUND OF THE INVENTION

1. Field of the Invention

The present invention generally relates to earth-boring drill bits and other tools that may be used to drill subterranean formations, and to methods of manufacturing such earth-boring drill bits.

2. State of the Art

Rotary drill bits are commonly used for drilling bore holes or wells in earth formations. One type of rotary drill bit is the fixed-cutter bit (often referred to as a "drag" bit), which typically includes a plurality of cutting elements secured to a face region of a bit body. Generally, the cutting elements of a fixed-cutter type drill bit have either a disk shape or a substantially cylindrical shape. A cutting surface comprising a hard, super-abrasive material, such as mutually bound particles of polycrystalline diamond, may be provided on a substantially circular end surface of each cutting element. Such cutting elements are often referred to as "polycrystalline diamond compact" (PDC) cutters. Typically, the cutting elements are fabricated separately from the bit body and secured within pockets formed in the outer surface of the bit body. A bonding material such as an adhesive or, more typically, a braze alloy may be used to secure the cutting elements to the bit body. The fixed-cutter drill bit may be placed in a bore hole such that the cutting elements are adjacent the earth formation to be drilled. As the drill bit is rotated, the cutting elements scrape across and shear away the surface of the underlying formation.

The bit body of a rotary drill bit typically is secured to a hardened steel shank having an American Petroleum Institute (API) thread connection for attaching the drill bit to a drill string. The drill string includes tubular pipe and equipment segments coupled end to end between the drill bit and other drilling equipment at the surface. Equipment such as a rotary table or top drive may be used for rotating the drill string and the drill bit within the bore hole. Alternatively, the shank of the drill bit may be coupled directly to the drive shaft of a down-hole motor, which then may be used to rotate the drill bit.

The bit body of a rotary drill bit may be formed from steel. Alternatively, the bit body may be formed from a particle-matrix composite material. Such bit bodies typically are formed by embedding a steel blank in a carbide particulate material volume, such as particles of tungsten carbide (WC), and infiltrating the particulate carbide material with a matrix material (often referred to as a "binder" material), such as a copper alloy, to provide a bit body substantially formed from a particle-matrix composite material. Drill bits that have a bit body formed from such a particle-matrix composite material may exhibit increased erosion and wear resistance relative to drill bits having steel bit bodies.

A conventional drill bit 10 that has a bit body including a particle-matrix composite material is illustrated in FIG. 1. As seen therein, the drill bit 10 includes a bit body 12 that is secured to a steel shank 20. The bit body 12 includes a crown 14, and a steel blank 16 that is embedded in the crown 14. The crown 14 includes a particle-matrix composite material such as, for example, particles of tungsten carbide embedded in a copper alloy matrix material. The bit body 12 is secured to the steel shank 20 by way of a threaded connection 22 and a weld 24 extending around the drill bit 10 on an exterior surface thereof along an interface between the bit body 12 and the steel shank 20. The steel shank 20 includes an API threaded connection portion 28 for attaching the drill bit 10 to a drill string (not shown).

The bit body 12 includes wings or blades 30, which are separated by junk slots 32. Internal fluid passageways 42 extend between the face 18 of the bit body 12 and a longitudinal bore 40, which extends through the steel shank 20 and partially through the bit body 12. Nozzle inserts (not shown) may be provided at face 18 of the bit body 12 within the internal fluid passageways 42.

A plurality of PDC cutters 34 is provided on the face 18 of the bit body 12. The PDC cutters 34 may be provided along the blades 30 within pockets 36 formed in the face 18 of the bit body 12, and may be supported from behind by buttresses 38, which may be integrally formed with the crown 14 of the bit body 12.

The steel blank 16 shown in FIG. 1 is generally cylindrically tubular. Alternatively, the steel blank 16 may have a fairly complex configuration and may include external protrusions corresponding to blades 30 or other features on and extending on the face 18 of the bit body 12.

During drilling operations, the drill bit 10 is positioned at the bottom of a well bore hole and rotated while drilling fluid is pumped to the face 18 of the bit body 12 through the longitudinal bore 40 and the internal fluid passageways 42. As the PDC cutters 34 shear or scrape away the underlying earth formation, the formation cutting mixes with and is suspended within the drilling fluid and passes through the junk slots 32 and the annular space between the well bore hole and the drill string to the surface of the earth formation.

Conventionally, bit bodies that include a particle-matrix composite material, such as the previously described bit body 12, have been fabricated in graphite molds. The cavities of the graphite molds are conventionally machined with a five-axis machine tool. Fine features are then added to the cavity of the graphite mold by hand-held tools. Additional clay work also may be required to obtain the desired configuration of some features of the bit body. Where necessary, preform elements or displacements (which may comprise ceramic components, graphite components, or resin-coated sand compact components) may be positioned within the mold and used to define the internal passageways 42, cutting element pockets 36, junk slots 32, and other external topographic features of the bit body 12. The cavity of the graphite mold is filled with hard particulate carbide material (such as tungsten carbide, titanium carbide, tantalum carbide, etc.). The preformed steel blank 16 may then be positioned in the mold at the appropriate location and orientation. The steel blank 16 typically is at least partially submerged in the particulate carbide material within the mold.

The mold then may be vibrated or the particles otherwise packed to decrease the amount of space between adjacent particles of the particulate carbide material. A matrix material, such as a copper-based alloy, may be melted, and the particulate carbide material may be infiltrated with the molten matrix material. The mold and bit body 12 are allowed to cool to solidify the matrix material. The steel blank 16 is bonded to the particle-matrix composite material forming the crown 14 upon cooling of the bit body 12 and solidification of the matrix material. Once the bit body 12 has cooled, the bit body 12 is removed from the mold and any displacements are removed from the bit body 12. Destruction of the graphite mold typically is required to remove the bit body 12.

As previously described, destruction of the graphite mold typically is required to remove the bit body 12. After the bit body 12 has been removed from the mold, the bit body 12 may be secured to the steel shank 20. As the particle-matrix composite material used to form the crown 14 is relatively hard and not easily machined, the steel blank 16 is used to secure the bit body to the shank. Threads may be machined on an exposed surface of the steel blank 16 to provide the threaded connection 22 between the bit body 12 and the steel shank 20. The steel shank 20 may be screwed onto the bit body 12, and the weld 24 then may be provided along the interface between the bit body 12 and the steel shank 20.

The PDC cutters 34 may be bonded to the face 18 of the bit body 12 after the bit body 12 has been cast by, for example, brazing, mechanical, or adhesive affixation. Alternatively, the cutters 34 may be bonded to the face 18 of the bit body 12 during furnacing of the bit body 12 if thermally stable synthetic or natural diamonds are employed in the cutters 34.

The molds used to cast bit bodies are difficult to machine due to their size, shape, and material composition. Furthermore, manual operations using hand-held tools are often required to form a mold and to form certain features in the bit body after removing the bit body from the mold, which further complicates the reproducibility of bit bodies. These facts, together with the fact that only one bit body can be cast using a single mold, complicate reproduction of multiple bit bodies having consistent dimensions. Due to these inconsistencies, the shape, strength, and ultimately the performance during drilling of each bit body may vary, which makes it difficult to ascertain the life expectancy of a given drill bit. As a result, the drill bits on a drill string are typically replaced more often than is desirable, in order to prevent unexpected drill bit failures, which results in additional costs.

As may be readily appreciated from the foregoing description, the process of fabricating a bit body that includes a particle-matrix composite material is a somewhat costly, complex, multi-step, labor-intensive process requiring separate fabrication of an intermediate product (the mold) before the end product (the bit body) can be cast. Moreover, the blanks, molds, and any preforms employed must be individually designed and fabricated. While bit bodies that include particle-matrix composite materials may offer significant advantages over prior art steel body bits in terms of abrasion and erosion-resistance, the lower strength and toughness of such bit bodies prohibit their use in certain applications.

Therefore, it would be desirable to provide a method of manufacturing a bit body that includes a particle-matrix composite material that eliminates the need of a mold, and that provides a bit body that can be easily attached to a shank or other component of a drill string. Furthermore, the known methods for forming a bit body that includes a particle-matrix composite material, limit the available compositions to those that include matrix materials that can be melted for infiltrating the particulate carbide material at temperatures that do not degrade the particulate carbide material, steel blank, or thermally stable diamonds contained in the mold assembly. Therefore, it would be desirable to provide a method of manufacturing suitable for producing a bit body that includes a particle-matrix composite material that does not require infiltration of particulate carbide material with a molten matrix material.

BRIEF SUMMARY OF THE INVENTION

In one aspect, the present invention includes a method of forming an earth-boring rotary drill bit. The method includes providing a bit body, providing a shank that is configured for attachment to a drill string, and attaching the shank to the bit body. Providing a bit body includes providing a green powder component having a first region having a first material composition and a second region having a second material composition that differs from the first material composition. The green powder component is at least partially sintered.

In another aspect, the present invention includes a method of forming an earth-boring rotary drill bit. The method includes providing a bit body and a shank that is configured for attachment to a drill string. The shank includes an outer wall enclosing a longitudinal bore and at least one aperture extending through the outer wall. At least one feature is machined in a surface of the bit body. The aperture extending through the outer wall of the shank is aligned with the feature in the surface of the bit body, and a retaining member is inserted through the aperture extending through the outer wall of the shank. Mechanical interference between the shank, the retaining member, and the feature in the surface of the bit body prevents separation of the bit body from the shank. The bit body is provided by pressing a powder mixture that includes a plurality of particles and a binder material to form a green powder component, which is then sintered to a final density.

In yet another aspect, the present invention includes an earth-boring rotary drill bit that includes a bit body and a shank attached to the bit body. The shank includes an outer wall enclosing a longitudinal bore. A retaining member extends through at least a portion of the outer wall of the shank and abuts against at least one surface of the bit body. Mechanical interference between the shank, the retaining member, and the bit body at least partially secures the shank to the bit body. The bit body includes a particle-matrix composite material. The particle-matrix composite material includes a plurality of hard particles dispersed throughout a matrix material. The hard particles may include a material selected from diamond, boron carbide, boron nitride, aluminum nitride, and carbides or borides of the group consisting of W, Ti, Mo, Nb, V, Hf, Zr, and Cr. The matrix material may be selected from the group consisting of iron-based alloys, nickel-based alloys, cobalt-based alloys, titanium-based alloys; iron and nickel-based alloys, iron and cobalt-based alloys, and nickel and cobalt-based alloys.

The features, advantages, and alternative aspects of the present invention will be apparent to those skilled in the art from a consideration of the following detailed description considered in combination with the accompanying drawings.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

The illustrations presented herein, are not meant to be actual views of any particular material, apparatus, system, or method, but are merely idealized representations which are employed to describe the present invention. Additionally, elements common between figures may retain the same numerical designation.

The term "green" as used herein means unsintered.

The term "green bit body" as used herein means an unsintered structure comprising a plurality of discrete particles held together by a binder material, the structure having a size and shape allowing the formation of a bit body suitable for use in an earth-boring drill bit from the structure by subsequent manufacturing processes including, but not limited to, machining and densification.

The term "brown" as used herein means partially sintered.

The term "brown bit body" as used herein means a partially sintered structure comprising a plurality of particles, at least some of which have partially grown together to provide at least partial bonding between adjacent particles, the structure having a size and shape allowing the formation of a bit body suitable for use in an earth-boring drill bit from the structure by subsequent manufacturing processes including, but not limited to, machining and further densification. Brown bit bodies may be formed by, for example, partially sintering a green bit body.

The term "sintering" as used herein means densification of a particulate component involving removal of at least a portion of the pores between the starting particles (accompanied by shrinkage) combined with coalescence and bonding between adjacent particles.

As used herein, the term "[metal]-based alloy" (where [metal] is any metal) means commercially pure [metal] in addition to metal alloys wherein the weight percentage of [metal] in the alloy is greater than the weight percentage of any other component of the alloy.

As used herein, the term "material composition" means the chemical composition and microstructure of a material. In other words, materials having the same chemical composition but a different microstructure are considered to have different material compositions.

As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

Figure 1:
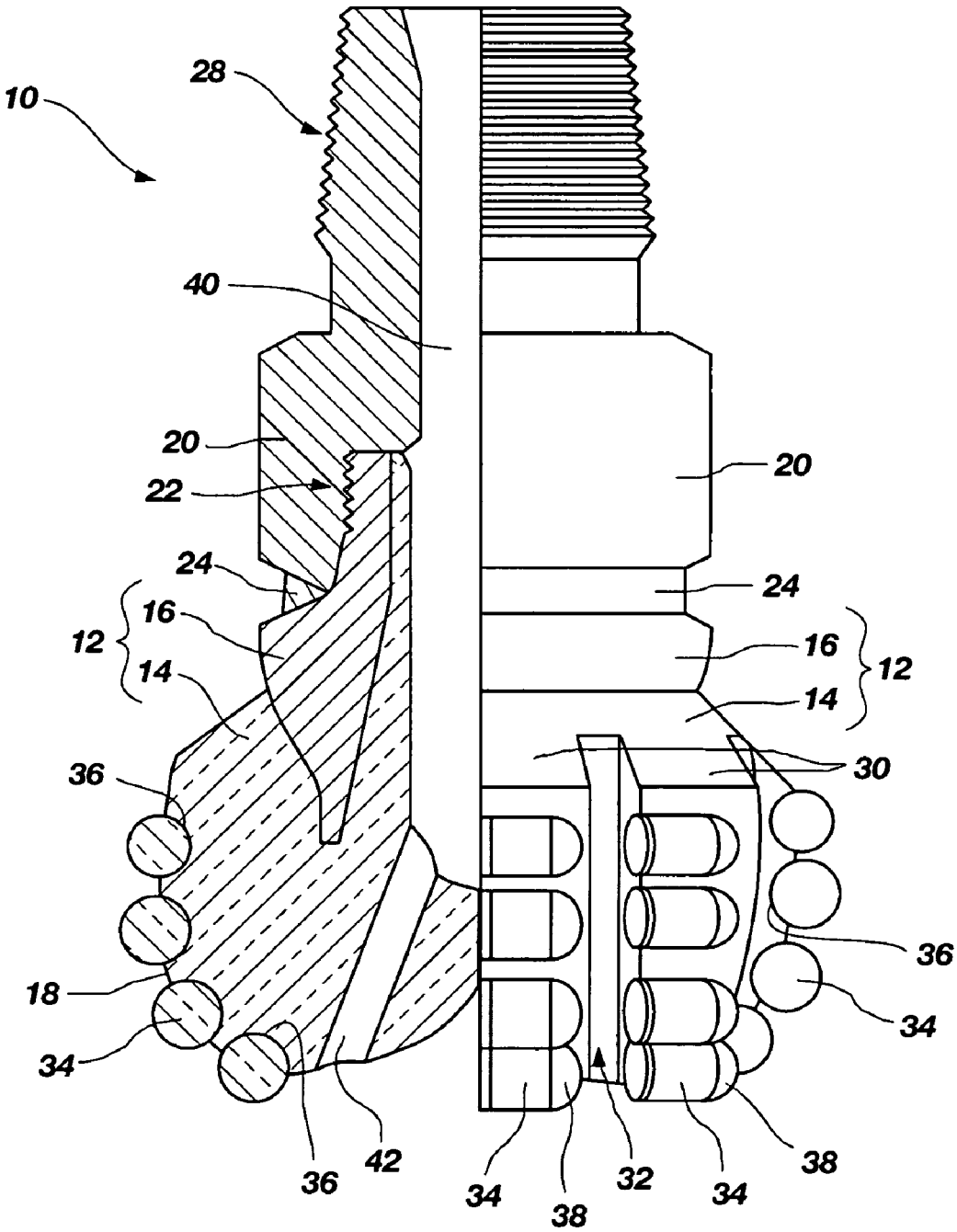
FIG. 1 (PRIOR ART)
FIG. 1 is a partial cross-sectional side view of a conventional rotary drill bit that has a bit body that includes a particle-matrix composite material.
Figure 2:
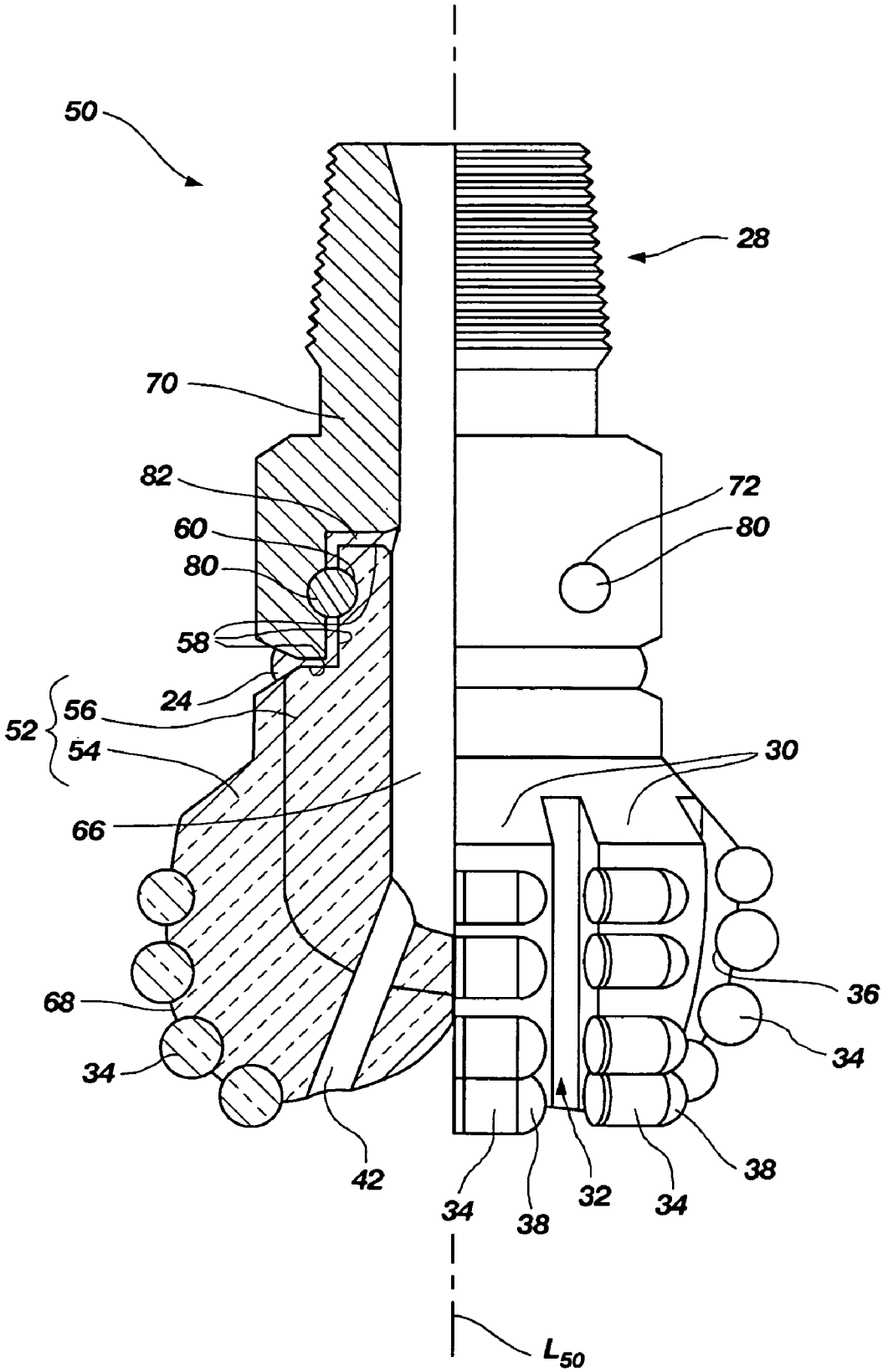
FIG. 2 is a partial cross-sectional side view of a rotary drill bit that embodies teachings of the present invention.

An earth-boring rotary drill bit 50 that embodies teachings of the present invention is shown in FIG. 2. The rotary drill bit 50 has a bit body 52 that includes a particle-matrix composite material. The drill bit 50 may also include a shank 70 attached to the bit body 52.

The shank 70 includes a generally cylindrical outer wall having an outer surface and an inner surface. The outer wall of the shank 70 encloses at least a portion of a longitudinal bore 66 that extends through the drill bit 50. At least one surface of the outer wall of the shank 70 may be configured for attachment of the shank 70 to the bit body 52. The shank 70 also may include a male or female API threaded connection portion 28 for attaching the drill bit 50 to a drill string (not shown). One or more apertures 72 may extend through the outer wall of the shank 70. These apertures are described in greater detail below.

In some embodiments, the bit body 52 of the rotary drill bit 50 may be substantially formed from and composed of a particle-matrix composite material. Furthermore, the composition of the particle-matrix composite material may be selectively varied within the bit body 52 to provide various regions within the bit body that have different, custom tailored physical properties or characteristics.

By way of example and not limitation, the bit body 52 may include a first region 54 having a first material composition and a second region 56 having a second, different material composition. The first region 54 may include the longitudinally lower and laterally outward regions of the bit body 52, which are commonly referred to as the "crown" of the bit body 52. The first region 54 may include the face 68 of the bit body 52, which may be configured to carry a plurality of cutting elements, such as PDC cutters 34. For example, a plurality of pockets 36 and buttresses 38 may be provided in or on the face 68 of the bit body 52 for carrying and supporting the PDC cutters 34. Furthermore, a plurality of blades 30 and junk slots 32 may be provided in the first region 54 of the bit body 52. The second region 56 may include the longitudinally upper and laterally inward regions of the bit body 52. The longitudinal bore 66 may extend at least partially through the second region 56 of the bit body 52.

The second region 56 may include at least one surface 58 that is configured for attachment of the bit body 52 to the shank 70. By way of example and not limitation, at least one groove 60 may be formed in at least one surface 58 of the second region 56 that is configured for attachment of the bit body 52 to the shank 70. Each groove 60 may correspond to and be aligned with an aperture 72 extending through the outer wall of the shank 70. A retaining member 80 may be provided within each aperture 72 in the shank 70 and each groove 60. Mechanical interference between the shank 70, the retaining member 80, and the bit body 52 may prevent longitudinal separation of the bit body 52 from the shank 70, and may prevent rotation of the bit body 52 about a longitudinal axis $L_{50}$ of the rotary drill bit 50 relative to the shank 70.

In the embodiment shown in FIG. 2, the rotary drill bit 50 includes two retaining members 80. By way of example and not limitation, each retaining member 80 may include an elongated, cylindrical rod that extends through an aperture 72 in the shank 70 and a groove 60 formed in a surface 58 of the bit body 52.

The mechanical interference between the shank 70, the retaining member 80, and the bit body 52 may also provide a substantially uniform clearance or gap between a surface of the shank 70 and the surfaces 58 in the second region 56 of the bit body 52. By way of example and not limitation, a substantially uniform gap of between about 50 microns (0.002 inch) and about 150 microns (0.006 inch) may be provided between the shank 70 and the bit body 52 when the retaining members 80 are disposed within the apertures 72 in the shank 70 and the grooves 60 in the bit body 52.

A brazing material 82 such as, for example, a silver-based or nickel-based metal alloy may be provided in the substantially uniform gap between the shank 70 and the surfaces 58 in the second region 56 of the bit body 52. As an alternative to brazing, or in addition to brazing, a weld 24 may be provided around the rotary drill bit 50 on an exterior surface thereof along an interface between the bit body 52 and the steel shank 70. The weld 24 and the brazing material 82 may be used to further secure the shank 70 to the bit body 52. In this configuration, if the brazing material 82 in the substantially uniform gap between the shank 70 and the surfaces 58 in the second region 56 of the bit body 52 and the weld 24 should fail while the drill bit 50 is located at the bottom of a well bore-hole during a drilling operation, the retaining members 80 may prevent longitudinal separation of the bit body 52 from the shank 70, thereby preventing loss of the bit body 52 in the well bore-hole.

As previously stated, the first region 54 of the bit body 52 may have a first material composition and the second region 56 of the bit body 52 may have a second, different material composition. The first region 54 may include a particle-matrix composite material. The second region 56 of the bit body 52 may include a metal, a metal alloy, or a particle-matrix composite material. By way of example and not limitation, the material composition of the first region 54 may be selected to exhibit higher erosion and wear-resistance than the material composition of the second region 56. The material composition of the second region 56 may be selected to facilitate machining of the second region 56. The manner in which the physical properties may be tailored to facilitate machining of the second region 56 may be at least partially dependent of the method of machining that is to be used. For example, if it is desired to machine the second region 56 using conventional turning, milling, and drilling techniques, the material composition of the second region 56 may be selected to exhibit lower hardness and higher ductility. Alternatively, if it is desired to machine the second region 56 using ultrasonic machining techniques, which may include the use of ultrasonically induced vibrations delivered to a tool, the composition of the second region 56 may be selected to exhibit a higher hardness and a lower ductility. In some embodiments, the material composition of the second region 56 may be selected to exhibit higher fracture toughness than the material composition of the first region 54. In yet other embodiments, the material composition of the second region 56 may be selected to exhibit physical properties that are tailored to facilitate welding of the second region 56. By way of example and not limitation, the material composition of the second region 56 may be selected to facilitate welding of the second region 56 to the shank 70. It is understood that the various regions of the bit body 52 may have material compositions that are selected or tailored to exhibit any desired particular physical property or characteristic, and the present invention is not limited to selecting or tailoring the material compositions of the regions to exhibit the particular physical properties or characteristics described herein.

Certain physical properties and characteristics of a composite material (such as hardness) may be defined using an appropriate rule of mixtures, as is known in the art. Other physical properties and characteristics of a composite material may be determined without resort to the rule of mixtures. Such physical properties may include, for example, erosion and wear resistance.

The particle-matrix composite material of the first region 54 may include a plurality of hard particles dispersed randomly throughout a matrix material. The hard particles may comprise diamond or ceramic materials such as carbides, nitrides, oxides, and borides (including boron carbide ($B_4C$)). More specifically, the hard particles may comprise carbides and borides made from elements such as W, Ti, Mo, Nb, V, Hf, Ta, Cr, Zr, Al, and Si. By way of example and not limitation, materials that may be used to form hard particles include tungsten carbide (WC, $W_2C$), titanium carbide (TiC), tantalum carbide (TaC), titanium diboride ($TiB_2$), chromium carbides, titanium nitride (TiN), vanadium carbide (VC), aluminium oxide ($Al_2O_3$), aluminium nitride (AlN), boron nitride (BN), and silicon carbide (SiC). Furthermore, combinations of different hard particles may be used to tailor the physical properties and characteristics of the particle-matrix composite material. The hard particles may be formed using techniques known to those of ordinary skill in the art. Most suitable materials for hard particles are commercially available and the formation of the remainder is within the ability of one of ordinary skill in the art.

The matrix material of the particle-matrix composite material may include, for example, cobalt-based, iron-based, nickel-based, iron and nickel-based, cobalt and nickel-based, iron and cobalt-based, aluminum-based, copper-based, magnesium-based, and titanium-based alloys. The matrix material may also be selected from commercially pure elements such as cobalt, aluminum, copper, magnesium, titanium, iron, and nickel. By way of example and not limitation, the matrix material may include carbon steel, alloy steel, stainless steel, tool steel, Hadfield manganese steel, nickel or cobalt superalloy material, and low thermal expansion iron- or nickel-based alloys such as INVAR®. As used herein, the term "superalloy" refers to an iron-, nickel-, and cobalt-based alloys having at least 12% chromium by weight. Additional exemplary alloys that may be used as matrix material include austenitic steels, nickel-based superalloys such as INCONEL® 625M or Rene 95, and INVAR® type alloys having a coefficient of thermal expansion that closely matches that of the hard particles used in the particular particle-matrix composite material. More closely matching the coefficient of thermal expansion of matrix material with that of the hard particles offers advantages such as reducing problems associated with residual stresses and thermal fatigue. Another exemplary matrix material is a Hadfield austenitic manganese steel (Fe with approximately 12% Mn by weight and 1.1% C by weight).

The material composition of the second region 56 of the bit body may include, for example, any of the previously described matrix materials of the particle-matrix composite material used for the first region 54 of the bit body 52. Alternatively, the material composition of the second region 56 of the bit body 52 may include a particle-matrix composite material in which hard particles are randomly dispersed throughout a matrix material. The hard particles and the matrix materials may be selected from those previously described in relation to the first region 54 of the bit body 52. The material composition of the second region 56 of the bit body 52, however, may be selected to facilitate machining of the second region 56 using conventional machining techniques. Such conventional machining techniques may include, for example, turning, milling, and drilling techniques, which may be used to configure the second region 56 of the bit body 52 for attachment to the shank 70. For example, features such as the grooves 60 may be machined in one or more surfaces 58 of the second region 56 of the bit body 52 to configure the second region 56 of the bit body 52 for attachment to the shank 70.

In one embodiment of the present invention, the first region 54 of the bit body 52 may be substantially formed from and composed of a particle-matrix composite material. The particle-matrix composite material may include a plurality of −400 ASTM (American Society for Testing and Materials) mesh tungsten carbide particles. As used herein, the phrase "−400 ASTM mesh particles" means particles that pass through an ASTM No. 400 mesh screen as defined in ASTM specification E11-04 entitled Standard Specification for Wire Cloth and Sieves for Testing Purposes. Such tungsten carbide particles may have a maximum diameter of less than about 38 microns. The matrix material may include a cobalt-based metal alloy comprising greater than about 95% cobalt by weight. The tungsten carbide particles may comprise between about 60% and about 95% by weight of the particle-matrix composite material, and the matrix material may comprise between about 5% and about 40% by weight of the particle-matrix composite material. More particularly, the tungsten carbide particles may comprise between about 75% and about 85% by weight of the particle-matrix composite material, and the matrix material may comprise between about 15% and about 25% by weight of the particle-matrix composite material.

The second region 56 of the bit body 52 may be substantially formed from and composed of the same material used as matrix material in the particle-matrix composite material of the first region 54.

In another embodiment of the present invention, both the first region 54 and the second region 56 of the bit body 52 may be substantially formed from and composed of a particle-matrix composite material.

By way of example and not limitation, the particle-matrix composite material of the first region 54 may include a plurality of −635 ASTM mesh tungsten carbide particles. As used herein, the phrase "−635 ASTM mesh particles" means particles that pass through an ASTM No. 635 mesh screen as defined in ASTM specification E11-04 entitled Standard Specification for Wire Cloth and Sieves for Testing Purposes. Such tungsten carbide particles may have a maximum diameter of less than about 20 microns. For example, the particle-matrix composite material of the first region 54 may include a plurality of tungsten carbide particles having a diameter in a range extending from about 0.5 micron to about 10 microns. The matrix material may include a nickel and cobalt-based metal alloy comprising about 50% nickel by weight and about 50% cobalt by weight. The tungsten carbide particles may comprise between about 60% and about 95% by weight of the particle-matrix composite material of the first region 54, and the matrix material may comprise between about 5% and about 40% by weight of the particle-matrix composite material of the first region 54. More particularly, the tungsten carbide particles may comprise between about 75% and about 85% by weight of the particle-matrix composite material of the first region 54, and the matrix material may comprise between about 15% and about 25% by weight of the particle-matrix composite material of the first region 54.

Furthermore, the particle-matrix composite material of the second region 56 may include a plurality of −635 ASTM mesh tungsten carbide particles. Such tungsten carbide particles may have a maximum diameter of less than about 20 microns. For example, the particle-matrix composite material of the second region 56 may include a plurality of tungsten carbide particles having a diameter in a range extending from about 0.5 micron to about 10 microns. The matrix material of the second region 56 may be substantially identical to the matrix material of the particle-matrix composite material of the first region 54. Alternatively, the matrix material of the particle-matrix composite material of the second region 56 may differ from the matrix material of the particle-matrix composite material of the first region 54. The tungsten carbide particles may comprise between about 65% and about 70% by weight of the particle-matrix composite material of the second region 56, and the matrix material may comprise between about 30% and about 35% by weight of the particle-matrix composite material of the second region 56.

FIGS. 3A through 3J illustrate a method of forming the bit body 52. Generally, the bit body 52 of the rotary drill bit 50 may be formed by separately forming the first region 54 and the second region 56 as brown structures, assembling the brown structures together to provide a unitary brown bit body, and sintering the unitary brown bit body to a desired final density.

Figure 3A:
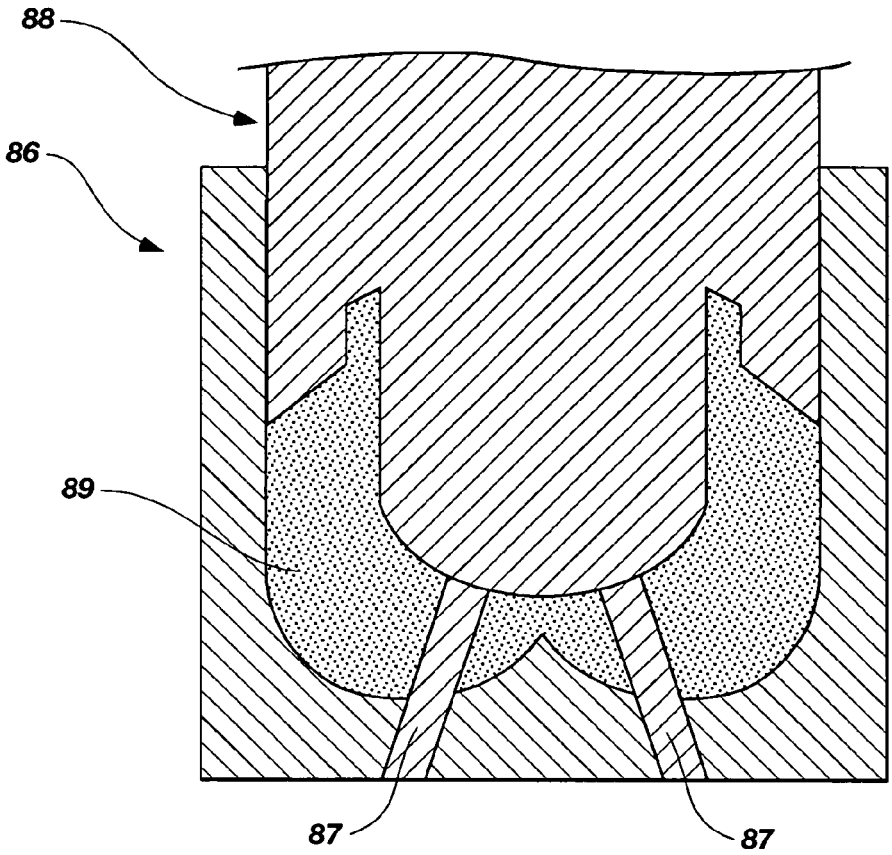
FIGS. 3A through 3J illustrate a method of forming the bit body of the earth-boring rotary drill bit shown in FIG. 2.

Referring to FIG. 3A, a first powder mixture 89 may be pressed in a mold or die 86 using a movable piston or plunger 88. The first powder mixture 89 may include a plurality of hard particles and a plurality of particles comprising a matrix material. The hard particles and the matrix material may be selected from those previously described in relation to FIG. 2. Optionally, the powder mixture 89 may further include additives commonly used when pressing powder mixtures such as, for example, binders for providing lubrication during pressing and for providing structural strength to the pressed powder component, plasticizers for making the binder more pliable, and lubricants or compaction aids for reducing interparticle friction.

The die 86 may include an inner cavity having surfaces shaped and configured to form at least some surfaces of the first region 54 of the bit body 52. The plunger 88 may also have surfaces configured to form or shape at least some of the surfaces of the first region 54 of the bit body 52. Inserts or displacements 87 may be positioned within the die 86 and used to define the internal fluid passageways 42. Additional displacements 87 (not shown) may be used to define cutting element pockets 36, junk slots 32, and other topographic features of the first region 54 of the bit body 52.

Figure 3B:
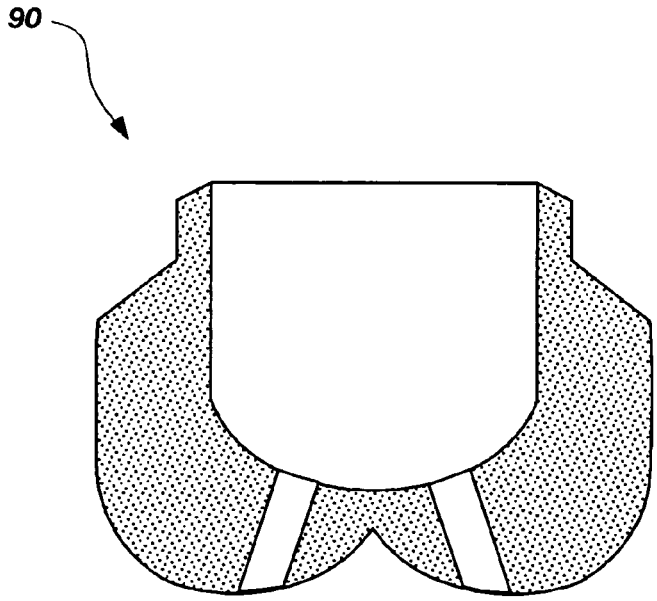
Figure 3C:
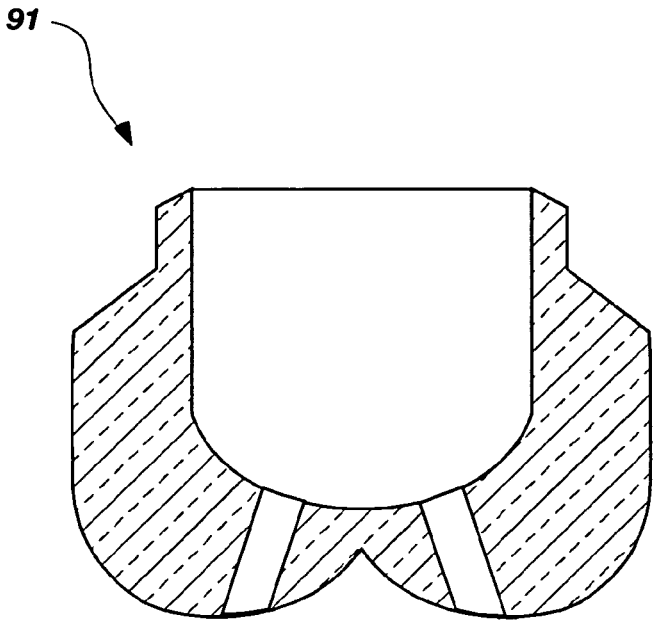

The plunger 88 may be advanced into the die 86 at high force using mechanical or hydraulic equipment or machines to compact the first powder mixture 89 within the die 86 to form a first green powder component 90, shown in FIG. 3B. The die 86, plunger 88, and the first powder mixture 89 optionally may be heated during the compaction process.

In alternative methods of pressing the powder mixture 89, the powder mixture 89 may be pressed with substantially isostatic pressures inside a pressure chamber using methods known to those of ordinary skill in the art.

The first green powder component 90 shown in FIG. 3B may include a plurality of particles (hard particles and particles of matrix material) held together by a binder material provided in the powder mixture 89 (FIG. 3A), as previously described. Certain structural features may be machined in the green powder component 90 using conventional machining techniques including, for example, turning techniques, milling techniques, and drilling techniques. Hand held tools also may be used to manually form or shape features in or on the green powder component 90. By way of example and not limitation, junk slots 32 (FIG. 2) may be machined or otherwise formed in the green powder component 90.

The first green powder component 90 shown in FIG. 3B may be at least partially sintered. For example, the green powder component 90 may be partially sintered to provide a first brown structure 91 shown in FIG. 3C, which has less than a desired final density. Prior to sintering, the green powder component 90 may be subjected to moderately elevated temperatures to aid in the removal of any fugitive additives that were included in the powder mixture 89 (FIG. 3A), as previously described. Furthermore, the green powder component 90 may be subjected to a suitable atmosphere tailored to aid in the removal of such additives. Such atmospheres may include, for example, hydrogen gas at a temperature of about 500° C.

Certain structural features may be machined in the first brown structure 91 using conventional machining techniques including, for example, turning techniques, milling techniques, and drilling techniques. Hand held tools may also be used to manually form or shape features in or on the brown structure 91. By way of example and not limitation, cutter pockets 36 may be machined or otherwise formed in the brown structure 91 to form a shaped brown structure 92 shown in FIG. 3D.

Figure 3D:
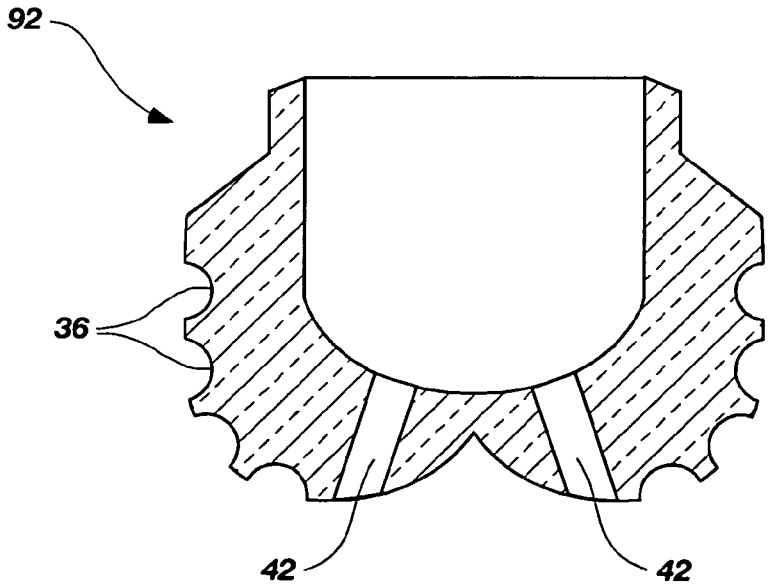
Figure 3E:
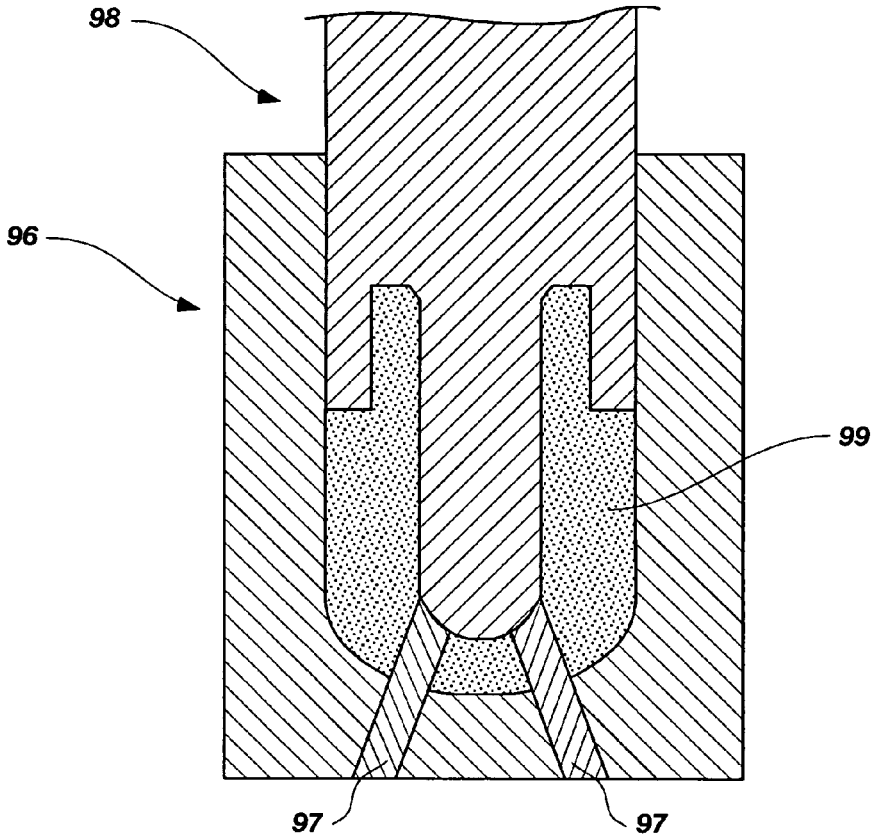

Referring to FIG. 3E, a second powder mixture 99 may be pressed in a mold or die 96 using a movable piston or plunger 98. The second powder mixture 99 may include a plurality of particles comprising a matrix material, and optionally may include a plurality of hard particles. The matrix material and the hard particles may be selected from those previously described in relation to FIG. 2. Optionally, the powder mixture 99 may further include additives commonly used when pressing powder mixtures such as, for example, binders for providing lubrication during pressing and for providing structural strength to the pressed powder component, plasticizers for making the binder more pliable, and lubricants or compaction aids for reducing inter-particle friction.

The die 96 may include an inner cavity having surfaces shaped and configured to form at least some surfaces of the second region 56 of the bit body 52. The plunger 98 may also have surfaces configured to form or shape at least some of the surfaces of the second region 56 of the bit body 52. One or more inserts or displacements 97 may be positioned within the die 96 and used to define the internal fluid passageways 42. Additional displacements 97 (not shown) may be used to define other topographic features of the second region 56 of the bit body 52 as necessary.

Figure 3F:
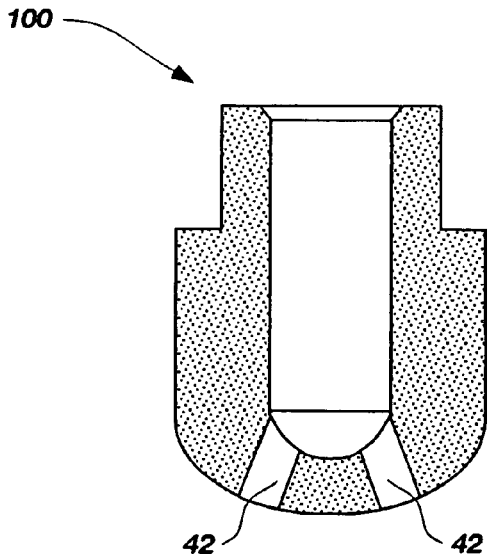

The plunger 98 may be advanced into the die 96 at high force using mechanical or hydraulic equipment or machines to compact the second powder mixture 99 within the die 96 to form a second green powder component 100, shown in FIG. 3F. The die 96, plunger 98, and the second powder mixture 99 optionally may be heated during the compaction process.

In alternative methods of pressing the powder mixture 99, the powder mixture 99 may be pressed with substantially isostatic pressures inside a pressure chamber using methods known to those of ordinary skill in the art.

The second green powder component 100 shown in FIG. 3F may include a plurality of particles (particles of matrix material, and optionally, hard particles) held together by a binder material provided in the powder mixture 99 (FIG. 3E), as previously described. Certain structural features may be machined in the green powder component 100 as necessary using conventional machining techniques including, for example, turning techniques, milling techniques, and drilling techniques. Hand held tools also may be used to manually form or shape features in or on the green powder component 100.

The second green powder component 100 shown in FIG. 3F may be at least partially sintered. For example, the green powder component 100 may be partially sintered to provide a second brown structure 101 shown in FIG. 3G, which has less than a desired final density. Prior to sintering, the green powder component 100 may be subjected to moderately elevated temperatures to burn off or remove any fugitive additives that were included in the powder mixture 99 (FIG. 3E), as previously described.

Certain structural features may be machined in the second brown structure 101 as necessary using conventional machining techniques including, for example, turning techniques, milling techniques, and drilling techniques. Hand held tools may also be used to manually form or shape features in or on the brown structure 101.

Figure 3G:
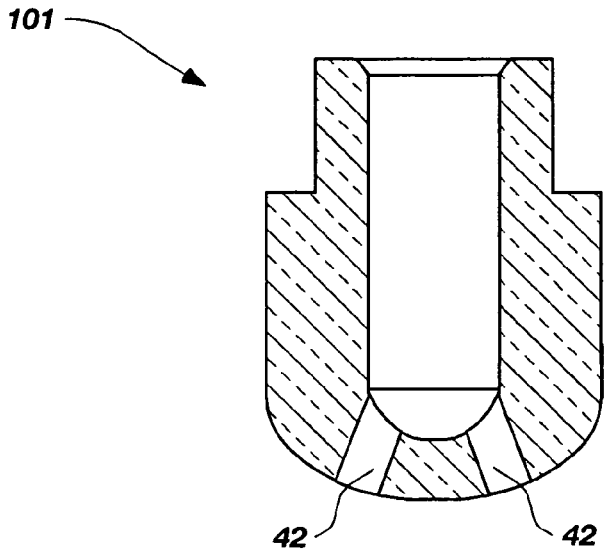
Figure 3H:
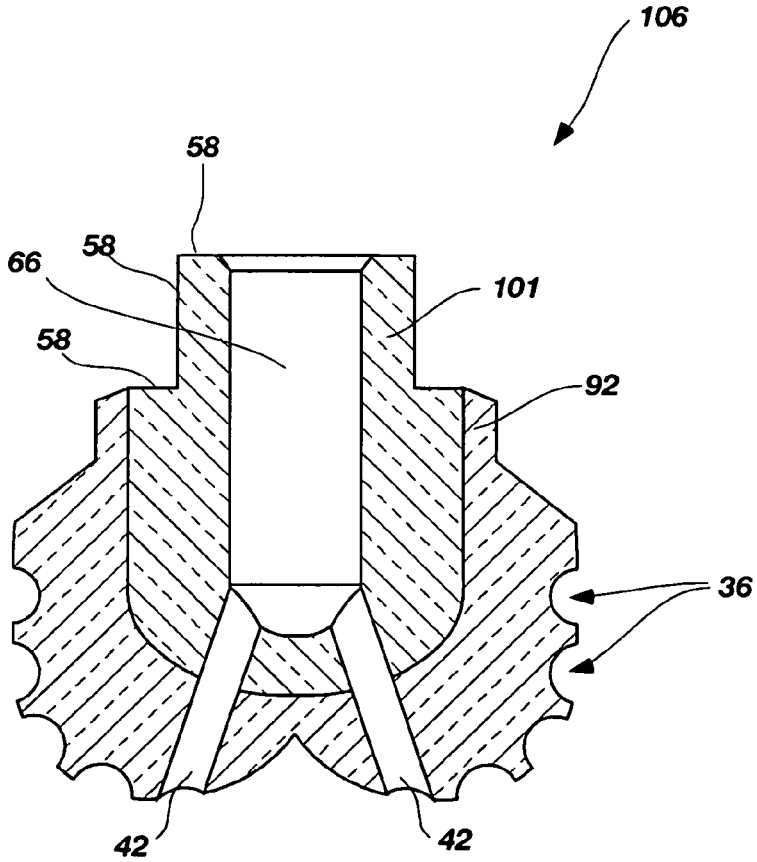

The brown structure 101 shown in FIG. 3G then may be inserted into the previously formed shaped brown structure 92 shown in FIG. 3D to provide a unitary brown bit body 106 shown in FIG. 3H. The unitary brown bit body 106 then may be fully sintered to a desired final density to provide the previously described bit body 52 shown in FIG. 2. As sintering involves densification and removal of porosity within a structure, the structure being sintered will shrink during the sintering process. A structure may experience linear shrinkage of between 10% and 20% during sintering. As a result, dimensional shrinkage must be considered and accounted for when designing tooling (molds, dies, etc.) or machining features in structures that are less than fully sintered.

In an alternative method, the green powder component 100 shown in FIG. 3F may be inserted into or assembled with the green powder component 90 shown in FIG. 3B to form a green bit body. The green bit body then may be machined as necessary and sintered to a desired final density. The interfacial surfaces of the green powder component 90 and the green powder component 100 may be fused or bonded together during sintering processes. Alternatively, the green bit body may be partially sintered to a brown bit body. Shaping and machining processes may be performed on the brown bit body as necessary, and the resulting brown bit body then may be sintered to a desired final density.

The material composition of the first region 54 (and therefore, the composition of the first powder mixture 89 shown in FIG. 3A) and the material composition of the second region 56 (and therefore, the composition of the second powder mixture 99 shown in FIG. 3E) may be selected to exhibit substantially similar shrinkage during the sintering processes.

The sintering processes described herein may include conventional sintering in a vacuum furnace, sintering in a vacuum furnace followed by a conventional hot isostatic pressing process, and sintering immediately followed by isostatic pressing at temperatures near the sintering temperature (often referred to as sinter-HIP). Furthermore, the sintering processes described herein may include subliquidus phase sintering. In other words, the sintering processes may be conducted at temperatures proximate to but below the liquidus line of the phase diagram for the matrix material. For example, the sintering processes described herein may be conducted using a number of different methods known to one of ordinary skill in the art such as the Rapid Omnidirectional Compaction (ROC) process, the CERACON™ process, hot isostatic pressing (HIP), or adaptations of such processes.

Broadly, and by way of example only, sintering a green powder compact using the ROC process involves presintering the green powder compact at a relatively low temperature to only a sufficient degree to develop sufficient strength to permit handling of the powder compact. The resulting brown structure is wrapped in a material such as graphite foil to seal the brown structure. The wrapped brown structure is placed in a container, which is filled with particles of a ceramic, polymer, or glass material having a substantially lower melting point than that of the matrix material in the brown structure. The container is heated to the desired sintering temperature, which is above the melting temperature of the particles of a ceramic, polymer, or glass material, but below the liquidus temperature of the matrix material in the brown structure. The heated container with the molten ceramic, polymer, or glass material (and the brown structure immersed therein) is placed in a mechanical or hydraulic press, such as a forging press, that is used to apply pressure to the molten ceramic or polymer material. Isostatic pressures within the molten ceramic, polymer, or glass material facilitate consolidation and sintering of the brown structure at the elevated temperatures within the container. The molten ceramic, polymer, or glass material acts to transmit the pressure and heat to the brown structure. In this manner, the molten ceramic, polymer, or glass acts as a pressure transmission medium through which pressure is applied to the structure during sintering. Subsequent to the release of pressure and cooling, the sintered structure is then removed from the ceramic, polymer, or glass material. A more detailed explanation of the ROC process and suitable equipment for the practice thereof is provided by U.S. Pat. Nos. 4,094,709, 4,233,720, 4,341,557, 4,526,748, 4,547,337, 4,562,990, 4,596,694, 4,597,730, 4,656,002 4,744,943 and 5,232,522, the disclosure of each of which patents is incorporated herein by reference.

The CERACON™ process, which is similar to the aforementioned ROC process, may also be adapted for use in the present invention to fully sinter brown structures to a final density. In the CERACON™ process, the brown structure is coated with a ceramic coating such as alumina, zirconium oxide, or chrome oxide. Other similar, hard, generally inert, protective, removable coatings may also be used. The coated brown structure is fully consolidated by transmitting at least substantially isostatic pressure to the coated brown structure using ceramic particles instead of a fluid media as in the ROC process. A more detailed explanation of the CERACON™ process is provided by U.S. Pat. No. 4,499,048, the disclosure of which patent is incorporated herein by reference.

Figure 3I:
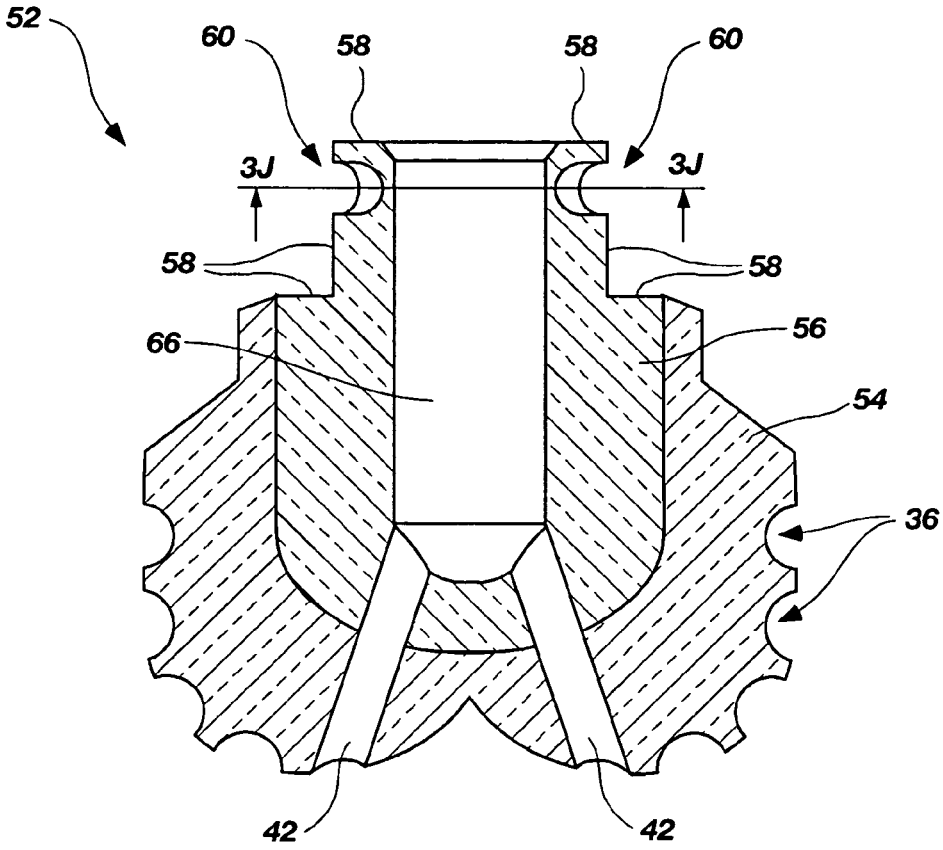
Figure 3J:
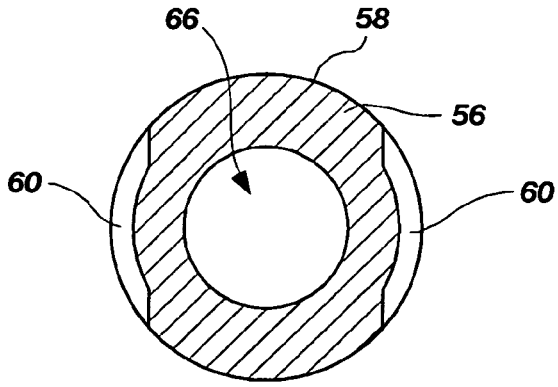

As previously described, the material composition of the second region 56 of the bit body 52 may be selected to facilitate the machining operations performing on the second region 56, even in the fully sintered state. After sintering the unitary brown bit body 106 shown in FIG. 3H to the desired final density, certain features may be machined in the fully sintered structure to provide the bit body 52, which is shown separate from the shank 70 (FIG. 2) in FIG. 3I. For example, the surfaces 58 of the second region 56 of the bit body 52 may be machined to provide elements or features for attaching the shank 70 (FIG. 2) to the bit body 52. By way of example and not limitation, two grooves 60 may be machined in a surface 58 of the second region 56 of the bit body 52, as shown in FIG. 3I. Each groove 60 may have, for example, a semi-circular cross section. Furthermore, each groove 60 may extend radially around a portion of the second region 56 of the bit body 52, as illustrated in FIG. 3J. In this configuration, the surface of the second region 56 of the bit body 52 within each groove 60 may have a shape comprising an angular section of a partial toroid. As used herein, the term "toroid" means a surface generated by a closed curve (such as a circle) rotating about, but not intersecting or containing, an axis disposed in a plane that includes the closed curve. Alternatively, the surface of the second region 56 of the bit body 52 within each groove 60 may have a shape that substantially forms a partial cylinder. The two grooves 60 may be located on substantially opposite sides of the second region 56 of the bit body 52, as shown in FIG. 3J.

As described herein, the first region 54 and the second region 56 of the drill bit 52 may be separately formed in the brown state and assembled together to form a unitary brown structure, which can then be sintered to a desired final density. In alternative methods of forming the bit body 52, the first region 54 may be formed by pressing a first powder mixture in a die to form a first green powder component, adding a second powder mixture to the same die and pressing the second powder mixture within the die together with the first powder component of the first region 54 to form a monolithic green bit body. Furthermore, a first powder mixture and a second powder mixture may be provided in a single die and simultaneously pressed to form a monolithic green bit body. The monolithic green bit body then may be machined as necessary and sintered to a desired final density. Alternatively, the monolithic green bit body may be partially sintered to a brown bit body. Shaping and machining processes may be performed on the brown bit body as necessary, and the resulting brown bit body then may be sintered to a desired final density. The monolithic green bit body may be formed in a single die using two different plungers, such as the plunger 88 shown in FIG. 3A and the plunger 98 shown in FIG. 3E. Furthermore, additional powder mixtures may be provided as necessary to provide any desired number of regions within the bit body 52 having a material composition.

Figure 4A:
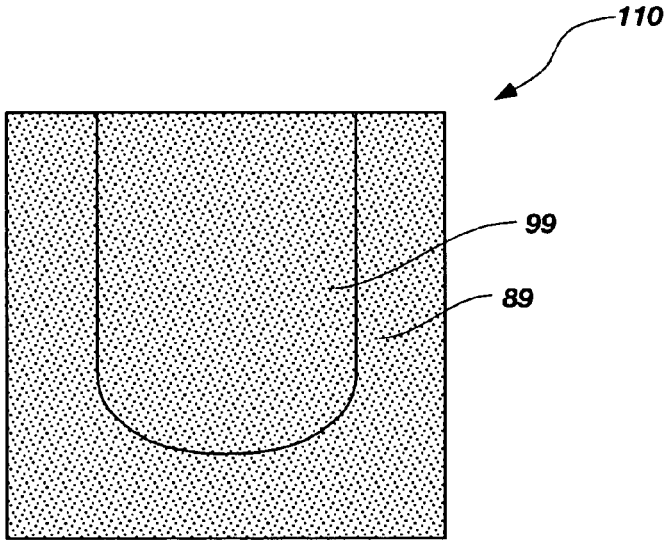
FIGS. 4A through 4C illustrate another method of forming the bit body of the earth-boring rotary drill bit shown in FIG. 2.
Figure 4B:
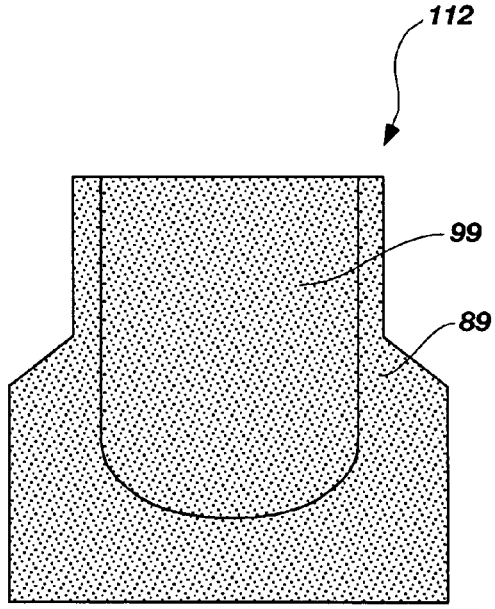
Figure 4C:
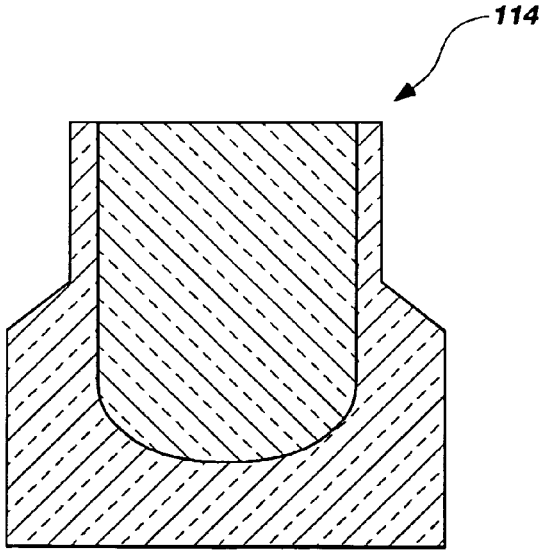

FIGS. 4A through 4C illustrate another method of forming the bit body 52. Generally, the bit body 52 of the rotary drill bit 50 may be formed by pressing the previously described first powder mixture 89 (FIG. 3A) and the previously described second powder mixture 99 (FIG. 3E) to form a generally cylindrical monolithic green bit body 110 or billet, as shown in FIG. 4A. By way of example and not limitation, the generally cylindrical monolithic green bit body 110 may be formed by isostatically pressing the first powder mixture 89 and the second powder mixture 99 together in a pressure chamber.

By way of example and not limitation, the first powder mixture 89 and the second powder mixture 99 may be provided within a container. The container may include a fluid-tight deformable member, such as, for example, a substantially cylindrical bag comprising a deformable polymer material. The container (with the first powder mixture 89 and the second powder mixture 99 contained therein) may be provided within a pressure chamber. A fluid, such as, for example, water, oil, or gas (such as, for example, air or nitrogen) may be pumped into the pressure chamber using a pump. The high pressure of the fluid causes the walls of the deformable member to deform. The pressure may be transmitted substantially uniformly to the first powder mixture 89 and the second powder mixture 99. The pressure within the pressure chamber during isostatic pressing may be greater than about 35 megapascals (about 5,000 pounds per square inch). More particularly, the pressure within the pressure chamber during isostatic pressing may be greater than about 138 megapascals (20,000 pounds per square inch). In alternative methods, a vacuum may be provided within the container and a pressure greater than about 0.1 megapascal (about 15 pounds per square inch), may be applied to the exterior surfaces of the container (by, for example, the atmosphere) to compact the first powder mixture 89 and the second powder mixture 99. Isostatic pressing of the first powder mixture 89 and the second powder mixture 99 may form the generally cylindrical monolithic green bit body 110 shown in FIG. 4A, which can be removed from the pressure chamber after pressing.

The generally cylindrical monolithic green bit body 110 shown in FIG. 4A may be machined or shaped as necessary. By way of example and not limitation, the outer diameter of an end of the generally cylindrical monolithic green bit body 110 may be reduced to form the shaped monolithic green bit body 112 shown in FIG. 4B. For example, the generally cylindrical monolithic green bit body 110 may be turned on a lathe to form the shaped monolithic green bit body 112. Additional machining or shaping of the generally cylindrical monolithic green bit body 110 may be performed as necessary or desired. Alternatively, the generally cylindrical monolithic green bit body 110 may be turned on a lathe to ensure that the monolithic green bit body 110 is substantially cylindrical without reducing the outer diameter of an end thereof or otherwise changing the shape of the monolithic green bit body 110.

The shaped monolithic green bit body 112 shown in FIG. 4B then may be partially sintered to provide a brown bit body 114 shown in FIG. 4C. The brown bit body 114 then may be machined as necessary to form a structure substantially identical to the previously described shaped unitary brown bit body 106 shown in FIG. 3H. By way of example and not limitation, the longitudinal bore 66 and internal fluid passageways 42 (FIG. 3H) may be formed in the brown bit body 114 (FIG. 4C) by, for example, using a machining process. A plurality of pockets 36 for PDC cutters 34 also may be machined in the brown bit body 114 (FIG. 4C). Furthermore, at least one surface 58 (FIG. 3H) that is configured for attachment of the bit body to the shank may be machined in the brown bit body 114 (FIG. 4C).

After the brown bit body 114 shown in FIG. 4C has been machined to form a structure substantially identical to the shaped unitary brown bit body 106 shown in FIG. 3H, the structure may be further sintered to a desired final density and certain additional features may be machined in the fully sintered structure as necessary to provide the bit body 52, as previously described.

Referring again to FIG. 2, the shank 70 may be attached to the bit body 52 by providing a brazing material 82 such as, for example, a silver-based or nickel-based metal alloy in the gap between the shank 70 and the surfaces 58 in the second region 56 of the bit body 52. As an alternative to brazing, or in addition to brazing, a weld 24 may be provided around the rotary drill bit 50 on an exterior surface thereof along an interface between the bit body 52 and the steel shank 70. The brazing material 82 and the weld 24 may be used to secure the shank 70 to the bit body 52.

Figure 5:
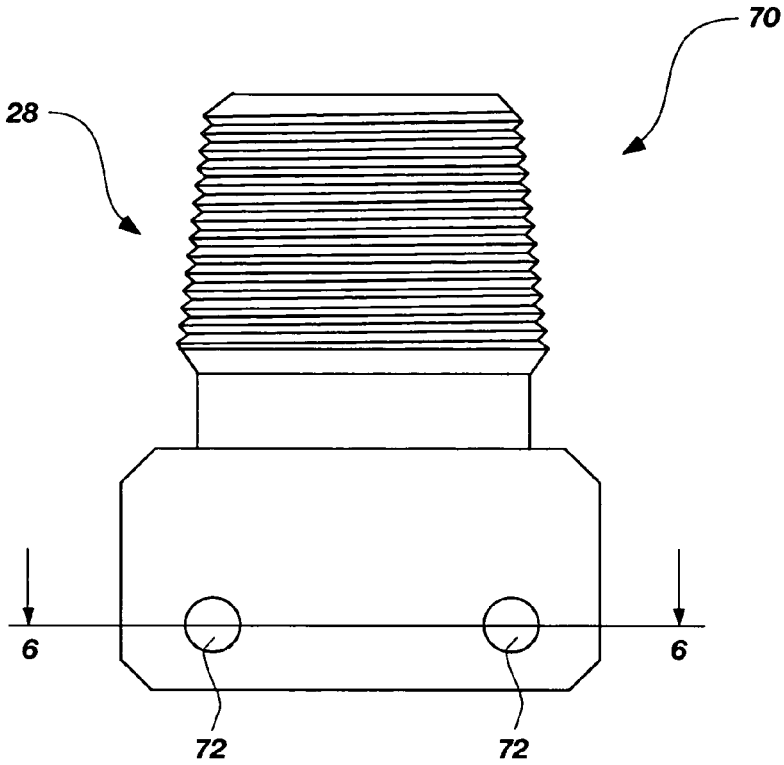
FIG. 5 is a side view of a shank shown in FIG. 2.
Figure 6:
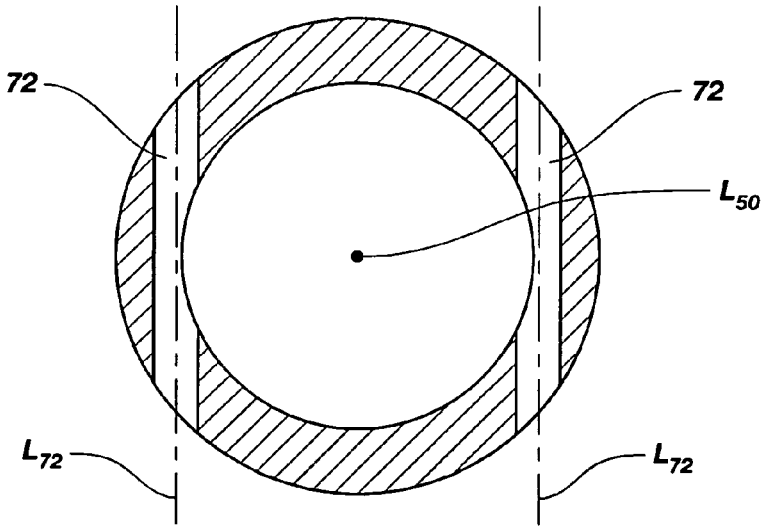
FIG. 6 is a cross-sectional view of the shank shown in FIG. 5 taken along section line 6-6 shown therein.

In alternative methods, structures or features that provide mechanical interference may be used in addition to, or instead of, the brazing material 82 and weld 24 to secure the shank 70 to the bit body 52. An example of such a method of attaching a shank 70 to the bit body 52 is described below with reference to FIG. 2 and FIGS. 5 and 6. Referring to FIG. 5, two apertures 72 may be provided through the shank 70, as previously described in relation to FIG. 2. Each aperture 72 may have a size and shape configured to receive a retaining member 80 (FIG. 2) therein. By way of example and not limitation, each aperture 72 may have a substantially cylindrical cross section and may extend through the shank 70 along an axis $L_{72}$, as shown in FIG. 6. The location and orientation of each aperture 72 in the shank 70 may be such that each axis $L_{72}$ lies in a plane that is substantially perpendicular to the longitudinal axis $L_{50}$ of the drill bit 50, but does not intersect the longitudinal axis $L_{50}$ of the drill bit 50.

When a retaining member 80 is inserted through an aperture 72 of the shank 70 and a groove 60, the retaining member 80 may abut against a surface of the second region 56 of the bit body 52 within the groove 60 along a line of contact if the groove 60 has a shape comprising an angular section of a partial toroid, as shown in FIGS. 3I and 3J. If the groove 60 has a shape that substantially forms a partial cylinder, however, the retaining member 80 may abut against an area on the surface of the second region 56 of the bit body 52 within the groove 60.

In some embodiments, each retaining member 80 may be secured to the shank 70. By way of example and not limitation, if each retaining member 80 includes an elongated, cylindrical rod as shown in FIG. 2, the ends of each retaining member 80 may be welded to the shank 70 along the interface between the end of each retaining member 80 and the shank 70. In other embodiments, a brazing or soldering material (not shown) may be provided between the ends of each retaining member 80 and the shank 70. In still other embodiments, threads may be provided on an exterior surface of each end of each retaining member and cooperating threads may be provided on surfaces of the shank 70 within the apertures 72.

Referring again to FIG. 2, the brazing material 82 such as, for example, a silver-based or nickel-based metal alloy may be provided in the substantially uniform gap between the shank 70 and the surfaces 58 in the second region 56 of the bit body 52. The weld 24 may be provided around the rotary drill bit 50 on an exterior surface thereof along an interface between the bit body 52 and the steel shank 70. The weld 24 and the brazing material 82 may be used to further secure the shank 70 to the bit body 52. In this configuration, if the brazing material 82 in the substantially uniform gap between the shank 70 and the surfaces 58 in the second region 56 of the bit body 52 and the weld 24 should fail while the drill bit 50 is located at the bottom of a well bore-hole during a drilling operation, the retaining members 80 may prevent longitudinal separation of the bit body 52 from the shank 70, thereby preventing loss of the bit body 52 in the well bore-hole.

In alternative methods of attaching the shank 70 to the bit body 52, only one retaining member 80 or more than two retaining members 80 may be used to attach the shank 70 to the bit body 52. In yet other embodiments, a threaded connection may be provided between the second region 56 of the bit body 52 and the shank 70. As the material composition of the second region 56 of the bit body 52 may be selected to facilitate machining thereof even in the fully sintered state, threads having precise dimensions may be machined on the second region 56 of the bit body 52. In additional embodiments, the interface between the shank 70 and the bit body 52 may be substantially tapered. Furthermore, a shrink fit or a press fit may be provided between the shank 70 and the bit body 52.

In the embodiment shown in FIG. 2, the bit body 52 includes two distinct regions having material compositions with an identifiable boundary or interface therebetween. In alternative embodiments, the material composition of the bit body 52 may be continuously varied between regions within the bit body 52 such that no boundaries or interfaces between regions are readily identifiable. In additional embodiments, the bit body 52 may include more than two regions having material compositions, and the spatial location of the various regions having material compositions within the bit body 52 may be varied.

Figure 7:
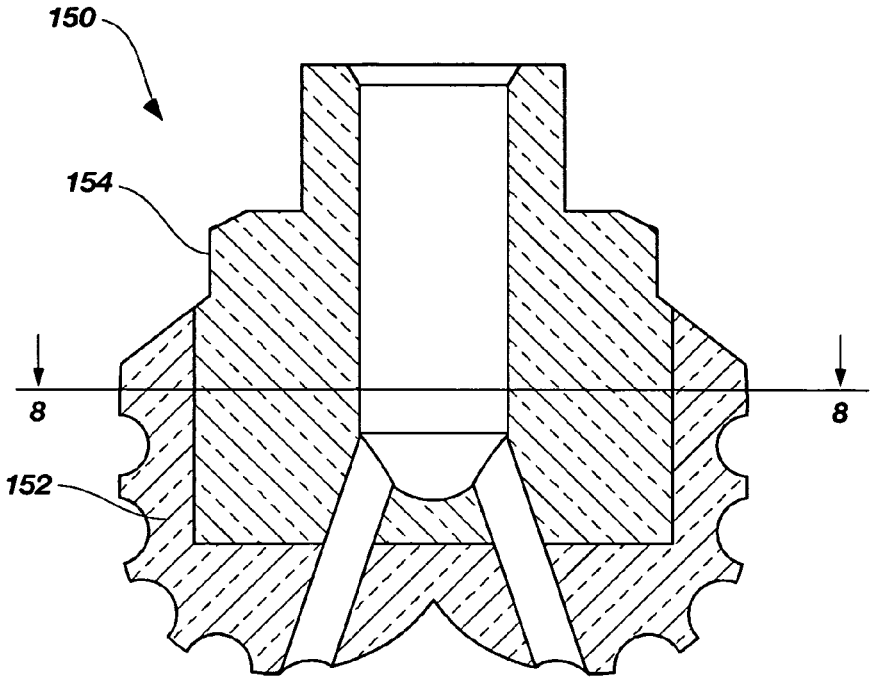
FIG. 7 is a cross-sectional side view of another bit body that embodies teachings of the present invention.
Figure 8:
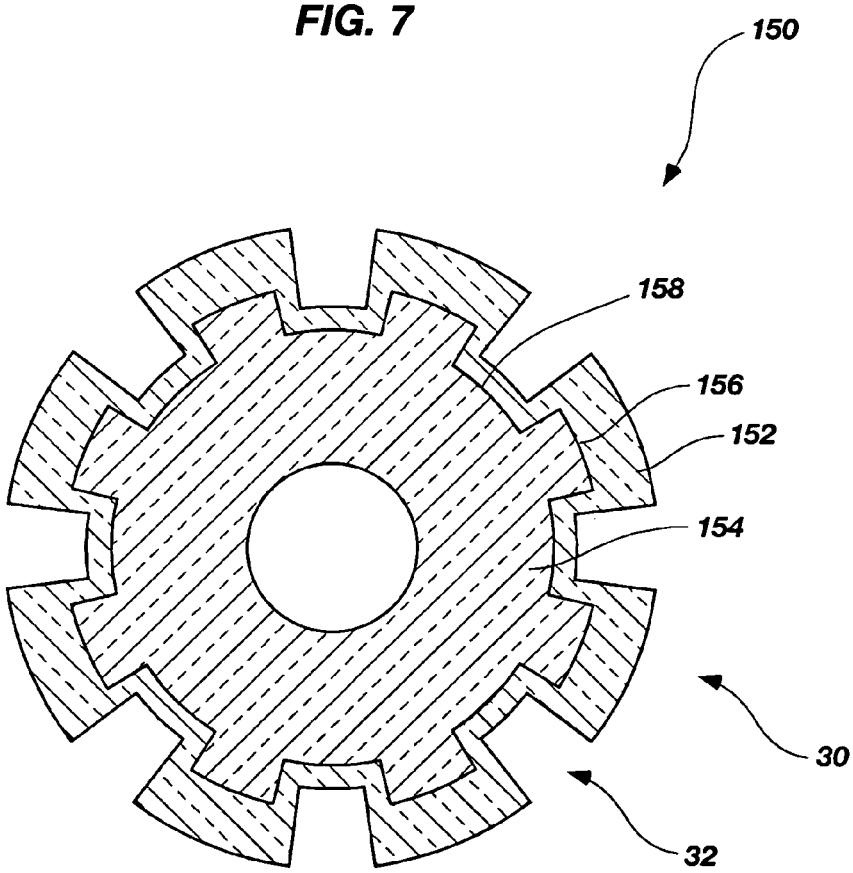
FIG. 8 is a cross-sectional view of the bit body shown in FIG. 7 taken along section line 8-8 shown therein.

FIG. 7 illustrates an additional bit body 150 that embodies teachings of the present invention. The bit body 150 includes a first region 152 and a second region 154. As best seen in the cross-sectional view of the bit body 150 shown in FIG. 8, the interface between the first region 152 and the second region 154 may generally follow the topography of the exterior surface of the first region 152. For example, the interface may include a plurality of longitudinally extending ridges 156 and depressions 158 corresponding to the blades 30 and junk slots 32 that may be provided on and in the exterior surface of the bit body 150. In such a configuration, blades 30 on the bit body 150 may be less susceptible to fracture when a torque is applied to a drill bit comprising the bit body 150 during a drilling operation.

Figure 9:
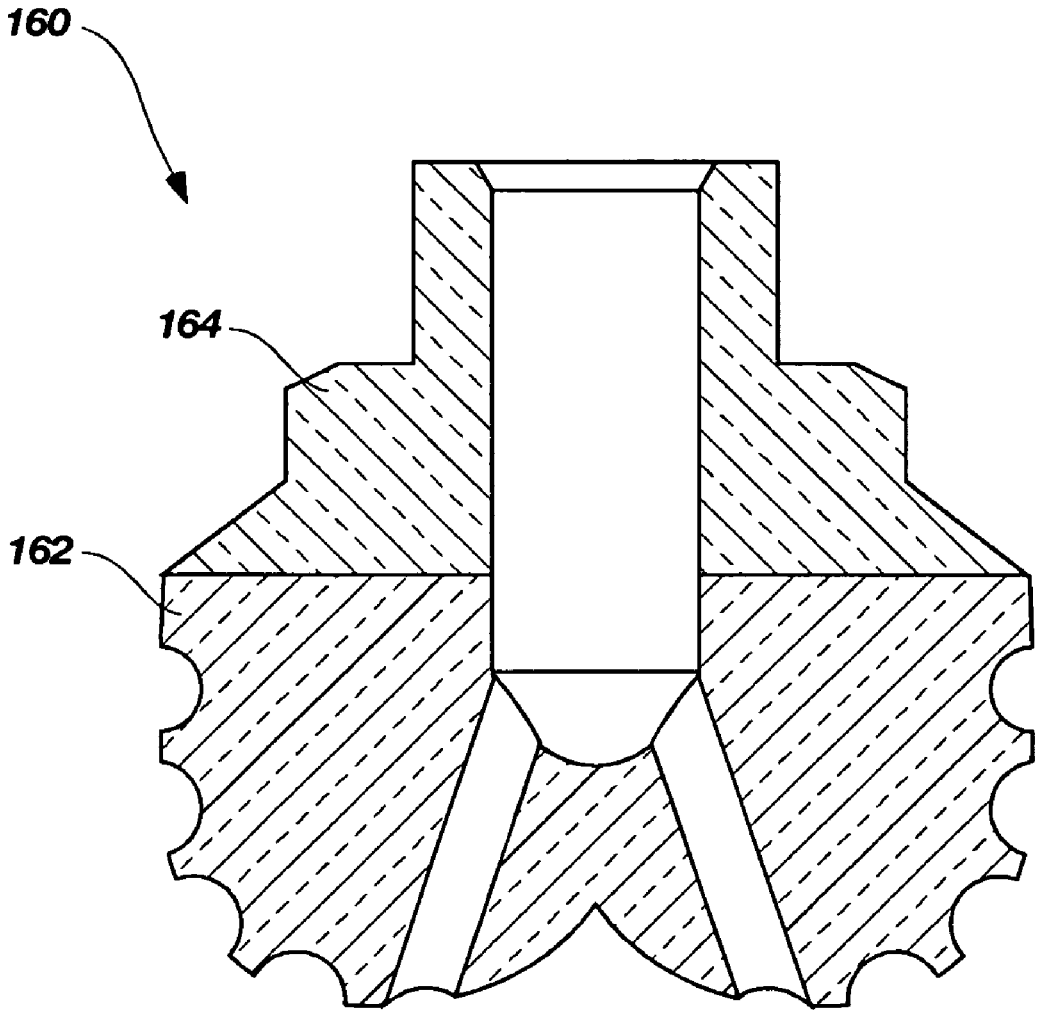
FIG. 9 is a cross-sectional side view of yet another bit body that embodies teachings of the present invention.

FIG. 9 illustrates yet another bit body 160 that embodies teachings of the present invention. The bit body 160 also includes a first region 162 and a second region 164. The first region 162 may include a longitudinally lower region of the bit body 160, and the second region 164 may include a longitudinally upper region of the bit body 160. Furthermore, the interface between the first region 162 and the second region 164 may include a plurality of radially extending ridges and depressions (not shown), which may make the bit body 160 less susceptible to fracture along the interface when a torque is applied to a drill bit comprising the bit body 160 during a drilling operation.

The methods of forming earth-boring rotary drill bits described herein may allow the formation of novel drill bits having bit bodies that include particle-matrix composite materials that exhibit superior erosion and wear-resistance, strength, and fracture toughness relative to known particle-matrix composite drill bits. Furthermore, the methods described herein allow for the attachment of a shank to a bit body that is substantially composed of a particle-matrix composite material and formed by methods other than liquid matrix infiltration. The methods allow for attachment of the shank to the bit body with proper alignment and concentricity provided therebetween. The methods described herein allow for improved attachment of a shank to a bit body having at least a crown region that includes a particle-matrix composite material by precision machining at least a surface of the bit body, the surface being configured for attachment of the bit body to the shank.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility in drill bits and core bits having different and various bit profiles as well as cutter types.

What is claimed is:

1. A method of forming a fixed cutter earth-boring rotary drill bit, the method comprising:

providing a bit body comprising:

pressing a first powder mixture to provide a first component having a first material composition;

pressing a second powder mixture to provide a second component having a second material composition that differs from the first material composition;

assembling the first component with the second component; and sintering the first component and the second component to a final density to bond the first component and the second component together and form the bit body; and fixedly attaching a shank to the bit body such that no relative movement is provided between the shank and the bit body during drilling, the shank configured for attachment to a drill string, fixedly attaching the shank to the bit body comprising:

positioning at least a portion of an inner surface of the shank circumferentially about a portion of the bit body;

inserting a retaining member through a first aperture extending through an outer surface of the shank and through at least one feature of the bit body; and at least partially securing the shank to the bit body using the retaining member.

2. The method of claim 1, further comprising:

formulating the first powder mixture to comprise:

a plurality of particles comprising a matrix material, the matrix material selected from the group consisting of cobalt-based alloys, iron-based alloys, nickel-based alloys, cobalt and nickel-based alloys, iron and nickel-based alloys, iron and cobalt-based alloys, aluminum-based alloys, copper-based alloys, magnesium-based alloys, and titanium-based alloys; and a plurality of hard particles comprising a material selected from diamond, boron carbide, boron nitride, aluminum nitride, and carbides or borides of the group consisting of W, Ti, Mo, Nb, V, Hf, Zr, and Cr.

3. The method of claim 2, wherein pressing the first powder mixture comprises:

pressing the first powder mixture in a die or receptacle.

4. The method of claim 3, wherein pressing the first powder mixture in the die or receptacle comprises isostatically pressing the first powder mixture.

5. The method of claim 1, further comprising:

formulating the first powder mixture to have a first powder composition; and forming a first green powder component upon pressing the first powder mixture;

formulating the second powder mixture to have a second powder composition differing from the first powder composition; and forming a second green powder component upon pressing the second powder mixture.

6. The method of claim 1, wherein the first material composition comprises:

a plurality of particles comprising a matrix material, the matrix material selected from the group consisting of nickel-based alloys, cobalt-based alloys, and nickel and cobalt-based alloys, the plurality of particles comprising a matrix material comprising between about 5% and about 25% by weight of the first composition; and a plurality of −400 ASTM mesh tungsten carbide particles, the plurality of tungsten carbide particles comprising between about 75% and about 95% by weight of the first material composition.

7. The method of claim 6, wherein the second material composition comprises:

a plurality of particles comprising a matrix material, the matrix material selected from the group consisting of nickel-based alloys, cobalt-based alloys, and nickel and cobalt-based alloys, the plurality of particles comprising a matrix material comprising between about 30% and about 35% by weight of the second composition; and a plurality of −400 ASTM mesh tungsten carbide particles, the plurality of tungsten carbide particles comprising between about 65% and about 70% by weight of the second material composition.

8. The method of claim 6, wherein the second material composition comprises a plurality of particles comprising a material selected from the group consisting of nickel-based alloys, cobalt-based alloys, and nickel and cobalt-based alloys.

9. The method of claim 1, further comprising machining the at least one feature in a surface of the bit body.

10. The method of claim 9, wherein the action of machining the at least one feature in the surface of the bit body comprises at least one of turning, milling, and drilling the at least one feature in the surface of the bit body.

11. The method of claim 9, wherein the action of machining the at least one feature in the surface of the bit body comprises machining at least one groove in the surface of the bit body.

12. The method of claim 1, wherein the action of fixedly attaching the shank to the bit body further comprises:

selecting the retaining member to comprise an elongated rod;

aligning the first aperture extending through the outer surface of the shank and a second aperture extending through the outer surface of the shank with the at least one feature of the bit body; and inserting the elongated rod through the first aperture extending through the outer surface of the shank, through the at least one feature of the bit body, and through the second aperture extending through the outer surface of the shank.

13. The method of claim 1, wherein the action of inserting the retaining member comprises providing a substantially uniform gap between at least one surface of the shank and at least one surface of the bit body.

14. The method of claim 13, wherein the action of providing a substantially uniform gap comprises forming the substantially uniform gap to be between about 50 microns (0.002 inch) and about 150 microns (0.006 inch).

15. The method of claim 1, further comprising providing a brazing alloy between at least one surface of the shank and at least one surface of the bit body.

16. The method of claim 1, further comprising welding an interface between the shank and the bit body.

17. The method of claim 1, wherein assembling the first component with the second component comprises assembling the first component with the second component after pressing the first powder mixture and pressing the second powder mixture.

* * * * *